US008672253B2

(12) United States Patent
Rothell

(10) Patent No.: US 8,672,253 B2
(45) Date of Patent: Mar. 18, 2014

(54) COLLAPSIBLE REEL TYPE DISPENSER WITH SWIVEL CLOSURE

(76) Inventor: Ronald Glenn Rothell, Santa Barbara, CA (US)

( * ) Notice: Subject to any disclaimer, the term of this patent is extended or adjusted under 35 U.S.C. 154(b) by 255 days.

(21) Appl. No.: 13/066,519

(22) Filed: Apr. 14, 2011

(65) Prior Publication Data

US 2011/0198430 A1 Aug. 18, 2011

Related U.S. Application Data

(63) Continuation-in-part of application No. 12/012,125, filed on Jan. 30, 2008, now Pat. No. 7,942,362.

(60) Provisional application No. 60/898,354, filed on Jan. 30, 2007.

(51) Int. Cl.
*B65H 75/22* (2006.01)

(52) U.S. Cl.
USPC ..... 242/401; 242/407.1; 242/607.1

(58) Field of Classification Search
USPC ..... 242/401, 407.1, 607.1
See application file for complete search history.

(56) References Cited

U.S. PATENT DOCUMENTS

| | | | | | |
|---|---|---|---|---|---|
| 496,283 | A | * | 4/1893 | Robinson | 242/396.6 |
| 1,017,936 | A | * | 2/1912 | Welty & Brinser | 242/407.1 |
| 1,825,488 | A | | 9/1929 | Tobin | |
| 3,058,688 | A | * | 10/1962 | Abel | 242/407.1 |
| 3,815,842 | A | | 6/1974 | Scrogin | |
| 3,837,597 | A | | 9/1974 | Bourhenne | |
| 4,700,908 | A | * | 10/1987 | Easter | 242/577.1 |
| RE34,376 | E | | 9/1993 | Branback | |
| 6,655,627 | B2 | | 12/2003 | Patton | |
| 7,080,802 | B2 | | 7/2006 | Bayer et al. | |
| 7,942,362 | B1 | * | 5/2011 | Rothell | 242/401 |

* cited by examiner

*Primary Examiner* — Sang Kim
(74) *Attorney, Agent, or Firm* — Philip T. Virga

(57) ABSTRACT

A collapsible reel-type apparatus provides a plurality of adjoining arm component axially joined to a plurality of adjoining leg component. The component so adjoined may be swiveled into a collapsed parallel condition for storage and an open perpendicular position for dispensing. Spring loaded elements automatically lock the components in the open position. Bearings located on the axial member above and below the sum arm component allow the free rotation of the arm component in the open position. Post guide members are adjustably secured to at least one arm component. An axially joined tubing guide extends outward and upward terminating in a looped enclosure. An upper retaining bar is detachably connected upon a coil with a tensioned retainer.

11 Claims, 27 Drawing Sheets

FIG 13a
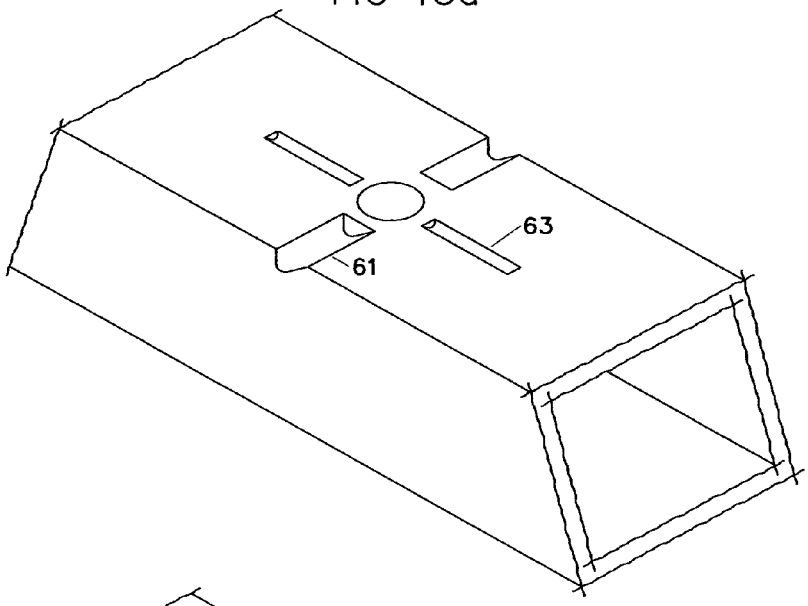
FIG 13b
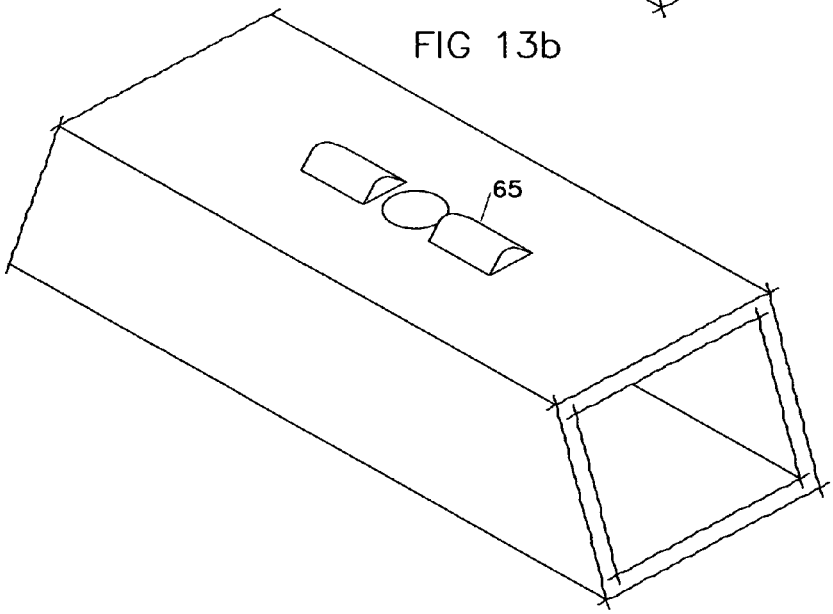
FIG 13

FIG 14a
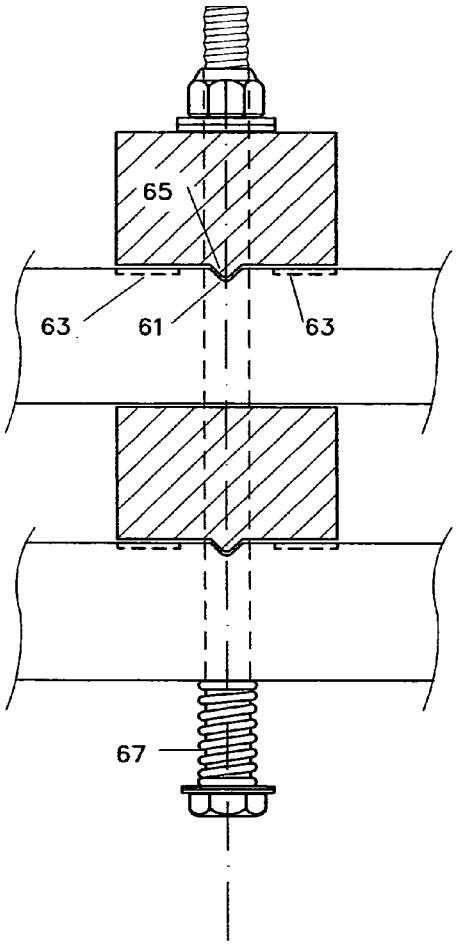
FIG 14b
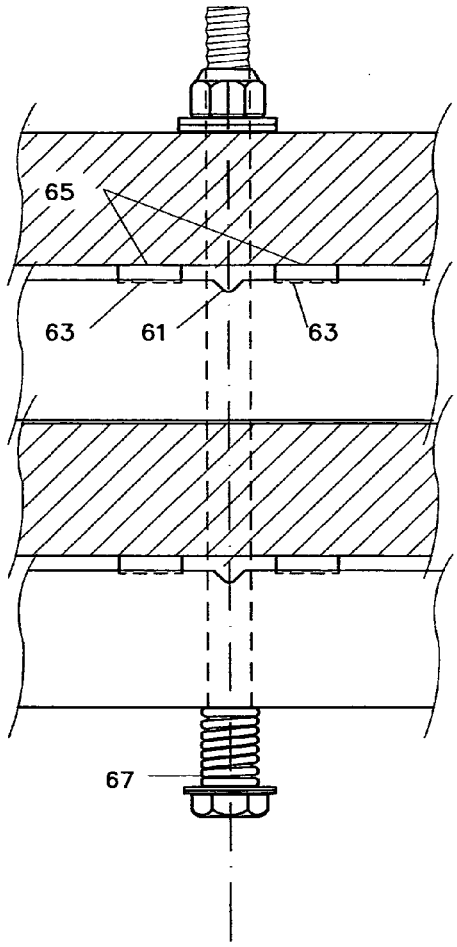
FIG. 14

FIG 23
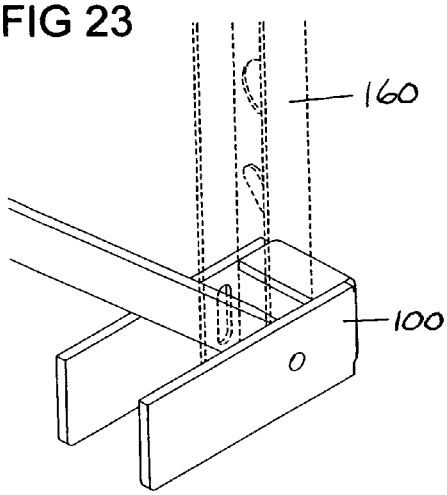
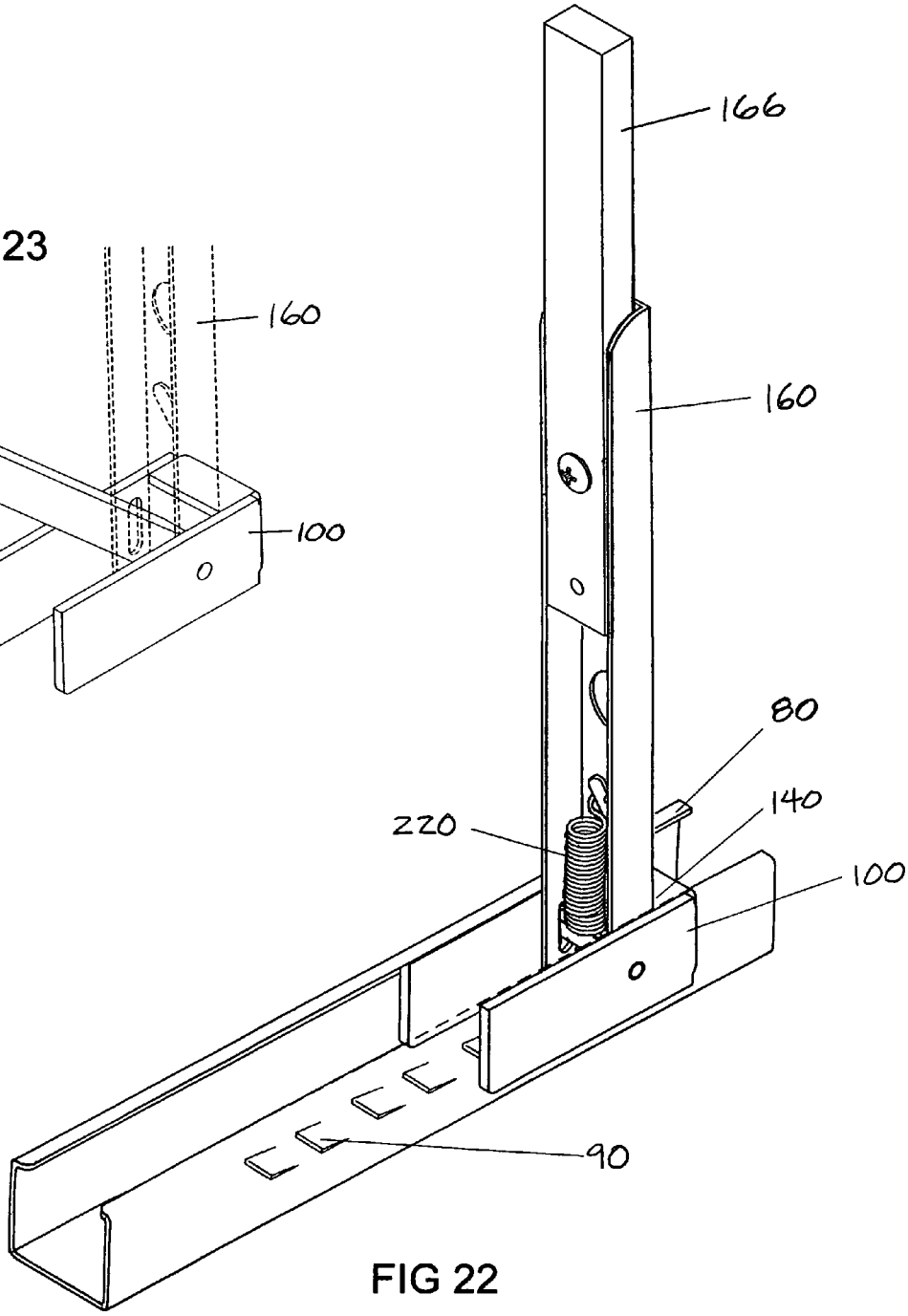
FIG 22

COLLAPSIBLE REEL TYPE DISPENSER WITH SWIVEL CLOSURE

CROSS REFERENCE TO RELATED APPLICATIONS

This continuation in part application claims the benefit of patent application Ser. No. 12/012,125 filed Jan. 30, 2008 now U.S. Pat. No. 7,942,362 which has since been allowed wherein that application claims the benefit of provisional patent application No. 60/898,354, filed Jan. 30, 2007 both filed by the same inventor.

BACKGROUND

1. Field of Invention

This invention relates to reel type dispensers, specifically those used in the construction field dispensing cable, wire, tubing and the like.

2. Background

Construction practice commonly requires the need to dispense large quantities of spooled or coiled materials. However, construction site conditions often provide unique challenges due to terrain features, impediments and difficulties for the transport and efficient installation of such materials.

There currently exists a variety of reel type dispensers that are used for the installation of coiled articles including electrical wire, cable, and communication cable by electricians, communication cable TV companies and other related concerns. Many of these dispensers are notably heavy and bulky, and of such dimension so as to lack portability and are therefore difficult to transport and store. Other dispensers offer portability by means of collapsible arm members yet require attachment to stud members, and are therefore limited in application. Still other dispensers are used to dispense tubing used for radiant heating system installations, flexible gas line, conduit tubing, and other coiled tubing. Many of these designs fail to offer collapsibility, are unwieldy, and/or suffer from overly complex and therefore costly designs. Yet others have a built in case that serves as the base for the dispenser. While an improvement in portability, this solution adds expense, complexity, and bulk.

Reel type dispensers often being employed to dispense relatively heavy material, previous designs often favored strength and simplicity yet neglected portability. U.S. Pat. No. 3,815,842 to Scrogin and U.S. Pat. No. 1,825,488 to Tobin for a fire hose dispenser demonstrates this solution. A large non-collapsible disk is supported by a cross stand assembly. Though U.S. Pat. No. 3,815,842 provide a handle, the lack of collapsibility of either dispenser inhibits useful portability. Though simple in concept, these solutions are inherently unwieldy regarding transportation and storage concerns.

U.S. Pat. No. 3,837,597 to Bourhenne provides for portability by means of a relatively compact and light weight disk incorporating a wire guide that also serves as a carry handle. A related embodiment of this patent incorporates folding arm members in place of the disk providing increased compactness. Yet both embodiments of this design are fundamentally limited in their usefulness by their specialized design that necessitates the dispenser be attached to a stud member by means of U-shaped leg members. The need to dispense coiled materials apart from such readily available stud members is not provided for.

U.S. Pat. No. 6,655,627 to Patton provides for portability by means of a disassembly and reassembly process comprising detachable arm members joined to a detachable rotary support member, then placed upon a base. The disassembled device is transported by means of a duffle bag, and then reassembled at the work location. While providing portability, this solution requires additional time for assembly and disassembly, and also is vulnerable to lost or damaged components defeating its use. The spindle type tubular cross sectional members comprising this modular spooler are less robust than designs having beam members with rectangular cross sectional or solid disc material support assemblies and are therefore more susceptible to damage. Furthermore, the three legged base assembly is less stable than a four legged base, making use on uneven surfaces less secure.

U.S. Pat. No. 7,080,802 to Bayer & Baus provides for portability by means of a self contained case that serves as the dispenser base. A central mast is raised and arm members folded down to form a dispensing surface with inner guides for the tubing inner diameter. This design uses four so called Guide bar placed over the central mast member and upon the top of the material dispensed. At least two of the so called Guide Bar must be employed to work properly and further must include means to lock together so as to turn simultaneously. As four of the Guide bars are used in practice, this solution requires more time to set up and change out rolls of dispensed material than designs incorporating a one-piece upper guide bar. Another problem with this design is the cost and bulk that the user must bear to have a case incorporated in the design. Also, the great designs and renders it vulnerable to damage to even one member defeating the dispensers use. Finally, the base of the design being a case lid, it is inherently not suitable for use on uneven floor surfaces.

U.S. Pat. No. Re 34,376 to Branback incorporates a radial bearing in a hole in the base member through which a shaft member is inserted and turns within. A cable guide member is placed upon the top of material to be dispensed from the device. No collapsibility is provided in the design, nor is any means provided to exert a continuous downward force upon the cable guide member. The latter omission may allow material to 'float' upwards while being dispensed due to uneven pullout speed of rotation during use, thereby fouling the dispenser. The relatively diminutive base used in this design is less stable than a widespread base and is inherently not suitable for use on uneven floor surfaces.

The need remains for a portable dispenser with a simple, strong, robust yet lightweight design having quick set up and closure time, requiring minimal storage space, able to readily accommodate a variety of coil sizes and materials with good control of materials uncoiled thereon, that can be set up apart from stud members or case lid components, and that is stable and capable of being used on uneven ground.

OBJECTS AND ADVANTAGES

The objects of my invention are as follows:

(a) to provide a truly portable reel dispenser for the efficient dispensing of coiled materials;

(b) to provide a portable reel dispenser with collapsibility to facilitate ease of transport and storage;

(c) to provide a portable reel dispenser with the greatest economy of design as possible to allow the lowest possible unit weight while providing good durability in field use;

(d) to provide a portable reel dispenser with the greatest economy of design as possible to allow the lowest possible unit cost;

(e) to provide a portable reel dispenser with a fully contained stable base assembly to facilitate unlimited applications apart from the availability of stud members or case components;

(f) to provide a portable reel dispenser having quick set up time and demounting time for efficient utilization in field use;

(g) to provide a dispenser that in certain embodiments can be used to reel-in elongate material onto the dispenser I shall describe several embodiments of my design which are directed to this end: However, many other embodiments serving vastly different applications are possible and are partially described in my final summary herein.

SUMMARY OF THE INVENTION

The invention provides an apparatus for securing and unwinding a length of elongate, flexible member of a coiled article from the coil. The apparatus provides a plurality of adjoining arm component axially joined to a plurality of adjoining leg component. The component so adjoined may be swiveled into a collapsed parallel condition for storage and an open perpendicular position for dispensing. Spring loaded elements automatically lock the components in the open position. Bearings located on the axial member above and below the sum arm component allow the free rotation of the arm component in the open position. Post guide members are adjustably secured to at least one arm component. An axially joined tubing guide extends outward and upward terminating in a looped enclosure. An upper retaining bar is detachably connected upon a coil with a tensioned retainer.

In another embodiment a bolt and various washer components serve as a simple axis assembly having a plurality of adjoining arm component combined with a plurality of adjoining leg component. The component so adjoined may be swiveled into a collapsed parallel condition for storage and an open perpendicular position for dispensing. A Teflon washer is located on the axial member below the sum arm component so as to allow the free rotation of the arm component in the open position. A nylon type lock nut is tightened onto the axis bolt, securing the assembly and adjustably controlling the rotation rate. Removable supports bridge the gap between upper and lower arm working surface. Hinged rail guides swivel into position to serve as a dual purpose material guide and means for locking the arm component together. Leg components are secured to the ground with a stake (not shown) placed through a hole provided in each leg extremity. Post guide members are adjustably secured to at least one arm component.

An important advantage of the present invention is that the dispenser can be quickly situated into an open condition for dispensing and collapsed into a closed, very compact condition for transport and storage by means of the individual members comprising the invention being swiveled around a common axis member.

Another advantage is that when configured in the open condition the dispenser has a low center of gravity, with the base of the dispenser having at least four leg appendages contacting the floor surface, and a relatively widespread base length, thereby making it very stable and capable of being securely used on uneven floor surfaces.

Another advantage is that the preferred material type and structure of the present embodiments of the invention to be manufactured, that being an aluminum channel type beam, is strong, robust and very durable yet relatively light weight, the first embodiment presented below weighing a little over 6 pounds.

An advantage of the present invention is that the dispenser is able to readily accommodate a variety of coil sizes and materials.

An advantage of the present invention is that the dispenser has a self-contained base and may be used apart from the availability of stud members or a case lid.

An advantage of one embodiment of the present invention is that the adjoining arm and adjoining leg components are automatically locked together when positioned in the open essentially perpendicular orientation for dispensing by a lock element lifted by a spring into contact with and engaging the adjacent component so adjoined, providing a quick set up of the device.

An advantage of one embodiment of the present invention is that unlocking the interlocked components is easily accomplished by depressing the lock element downward into the channel cavity and swiveling the components into the closed essentially parallel position, providing a quick demounting of the device.

An advantage of one embodiment of the present invention is a tubing guide included within the axial assembly and extending outward beyond the coil periphery and upward above the working surface of the rotary material support and terminating with a looped enclosure to receive and guide the coil section moving away from the coil during dispensing, preventing the material from fouling the dispenser.

An advantage of one embodiment of the present invention is an upper retaining element detachably mounted upon the top of a coil to be dispensed and joined with an elastic tensioning element to the dispenser, preventing coiled material from moving upward and fouling the dispenser operation.

An advantage of one embodiment of the present invention is a hinged, collapsible peripheral rail assemblage that may optionally be positioned around the periphery of the dispenser by connecting members so as guide the coil section moving away from the coiled article, and also functions as a connecting element to join the upper arm components together as one rotary material support.

An advantage of one embodiment of the present invention is that the axial member is essentially engaged with at least one component of the rotary material support or base whereby the component and axial member so engaged rotate as one An important aspect of one embodiment of the present invention is that a shaft member of the axial assembly is essentially engaged to at least one arm or leg component and extends beyond at least one terminal end of the aggregate component and may be thereby attached to rotational drive means to reel in or reel out the coiled article.

An aspect of one embodiment of the invention is a plurality of formed track member pivotally attached to the upper leg component so as to be selectively pivotable between a collapsed vertically parallel condition for storage and an open horizontally planar position for dispensing, the track member further supported by an underlying leg in the open position. A plurality of load-bearing roller element terminating in free turning roller and extending downward are attached to the arm component so as to place the free turning rollers upon the roller track in the open position, thereby transmitting load forces from the arm component to the leg component, thus reinforcing the dispenser and further stabilizing the coiled article.

DRAWING FIGURES

Figure 2:
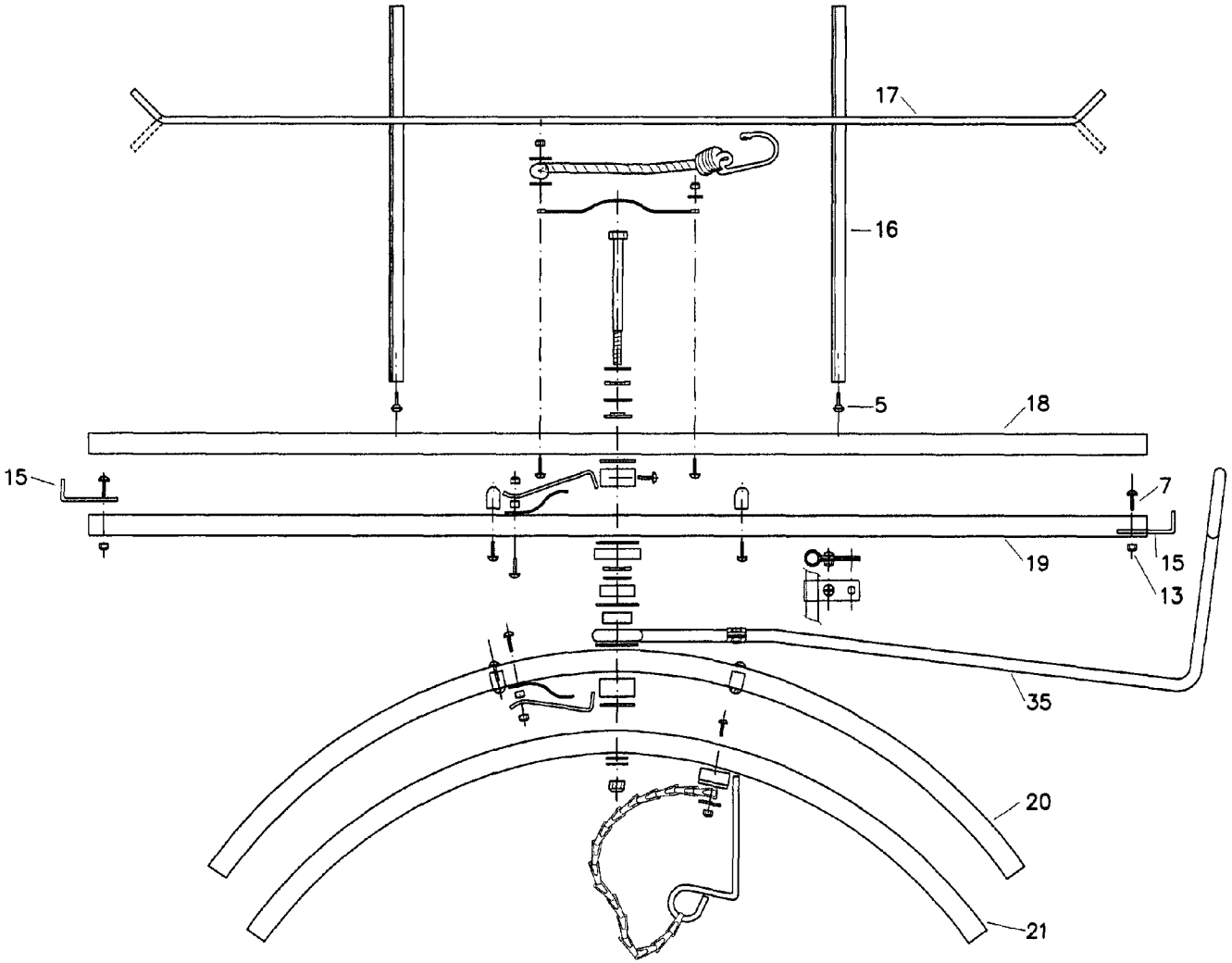
FIG. 2 shows the same embodiment (exploded elevation)
Figure 2A:
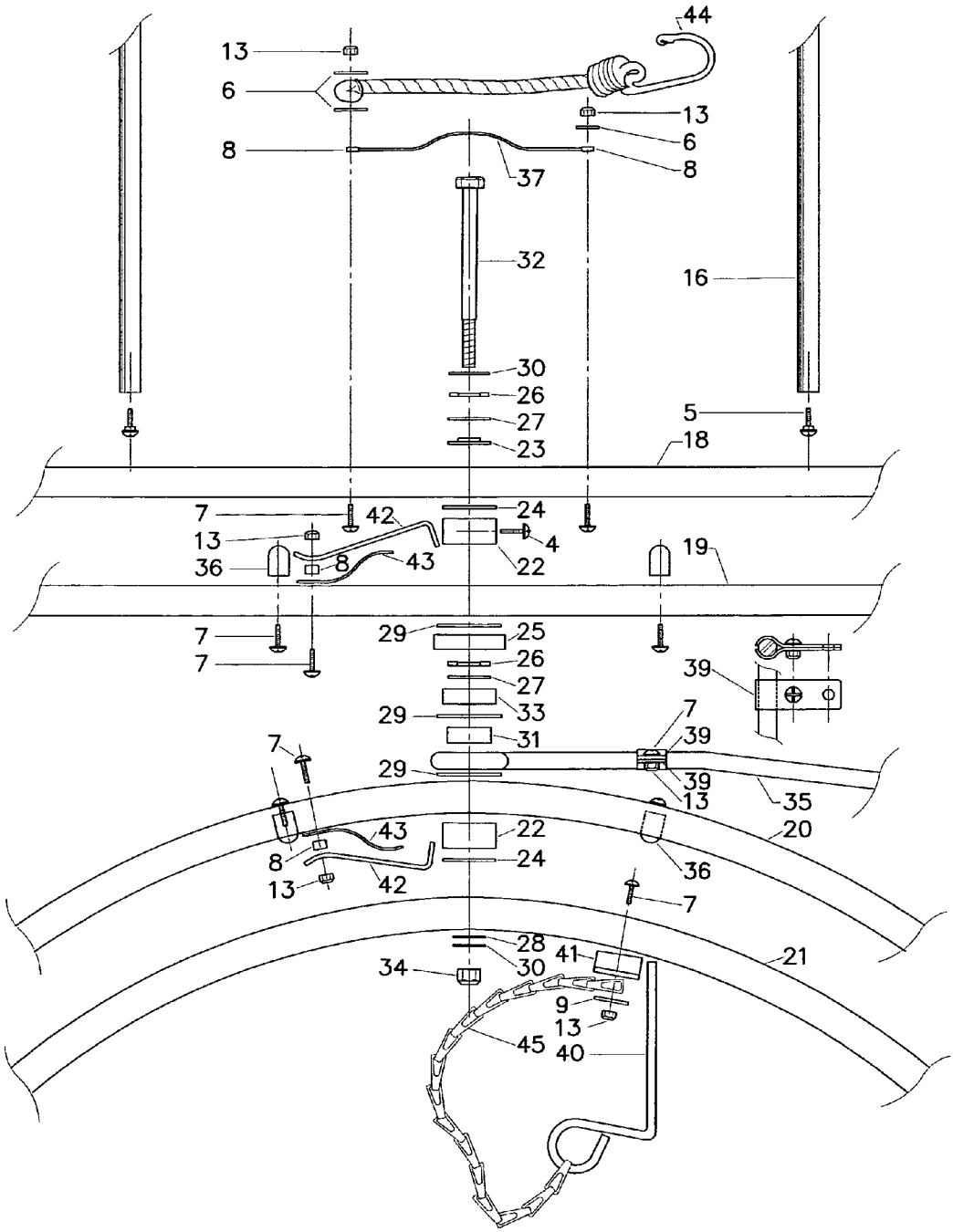

FIG. 2*a* shows an enlarged section of the axis assembly shown in FIG. 2 (exploded elevation)

Figure 3:
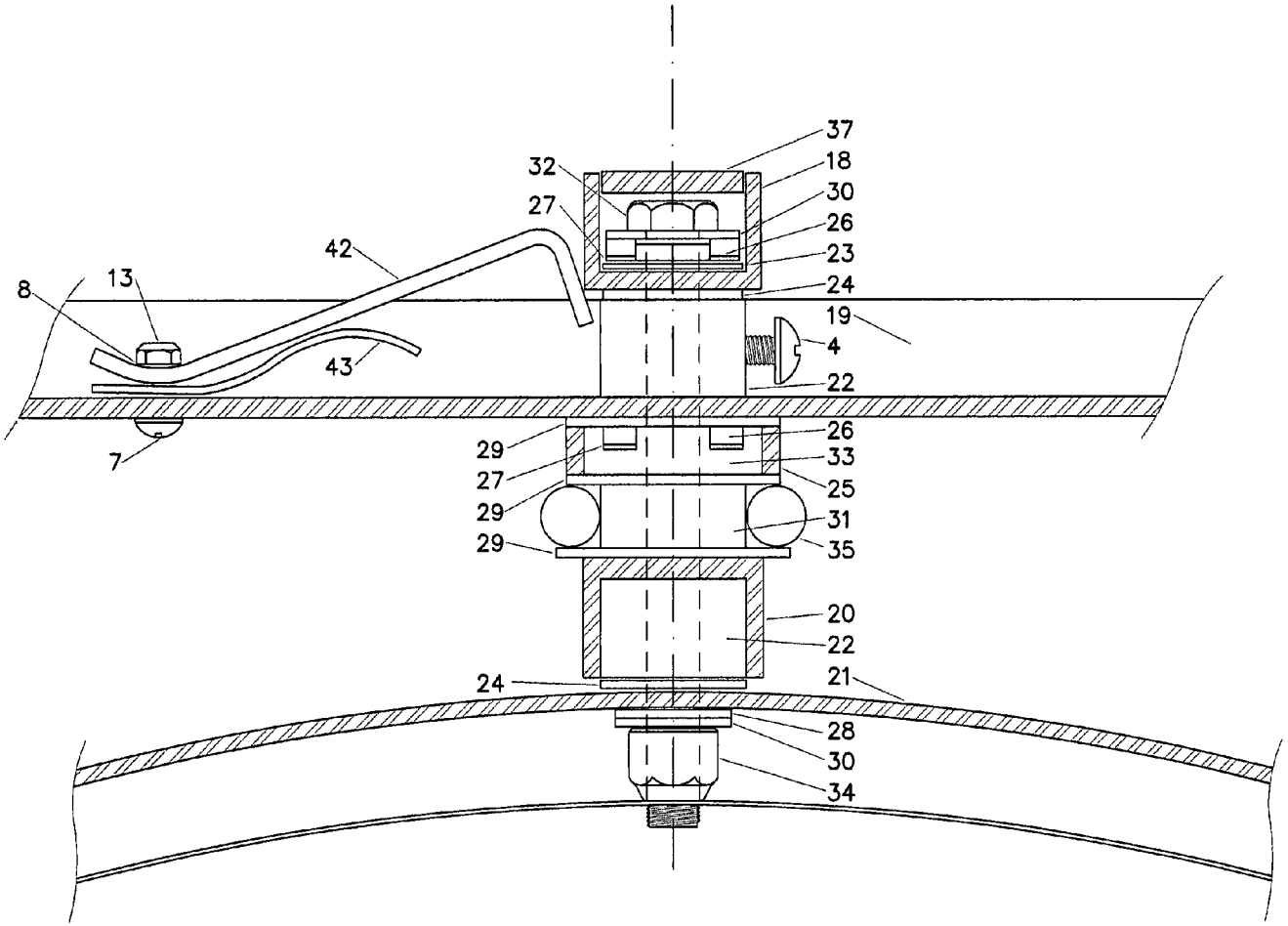

FIG. 3 shows the axis assembly of the same embodiment (elevation-sectional)

Figure 3A:
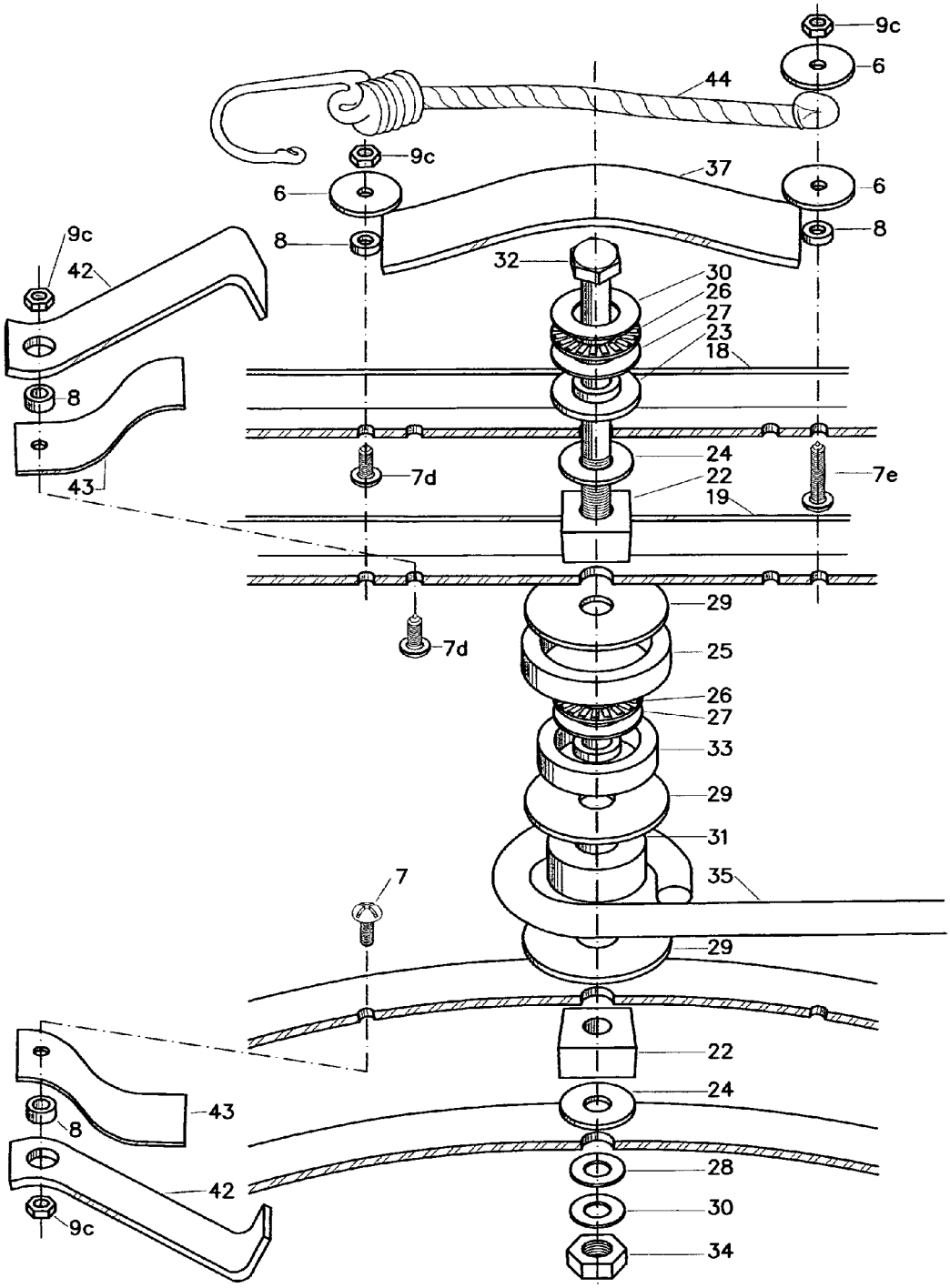

FIG. 3*a* shows the axis assembly of the same embodiment (exploded isometric-sectional)

Figure 4:
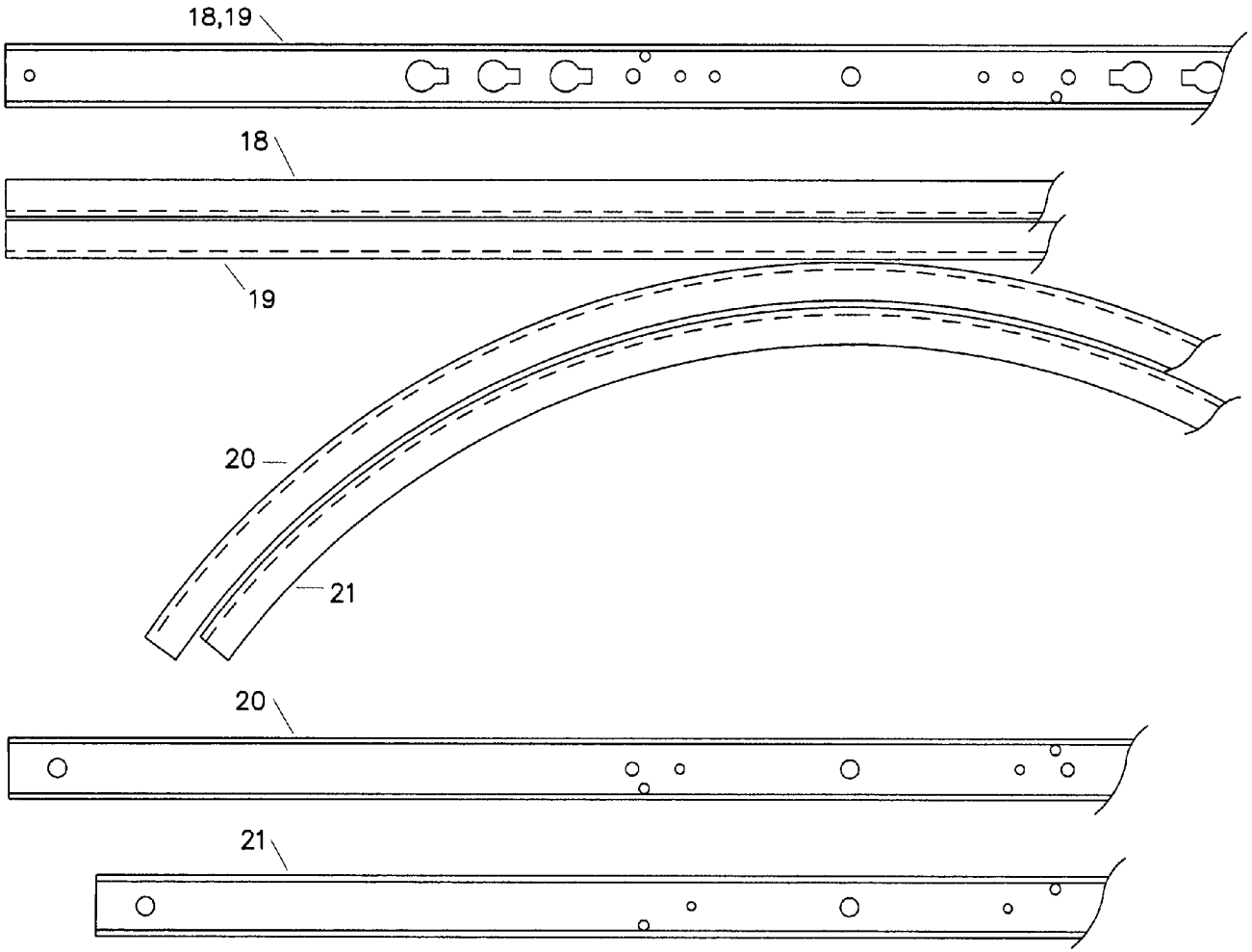

FIG. 4 shows the hole pattern located on the arm and leg members (elevation)

Figure 5:
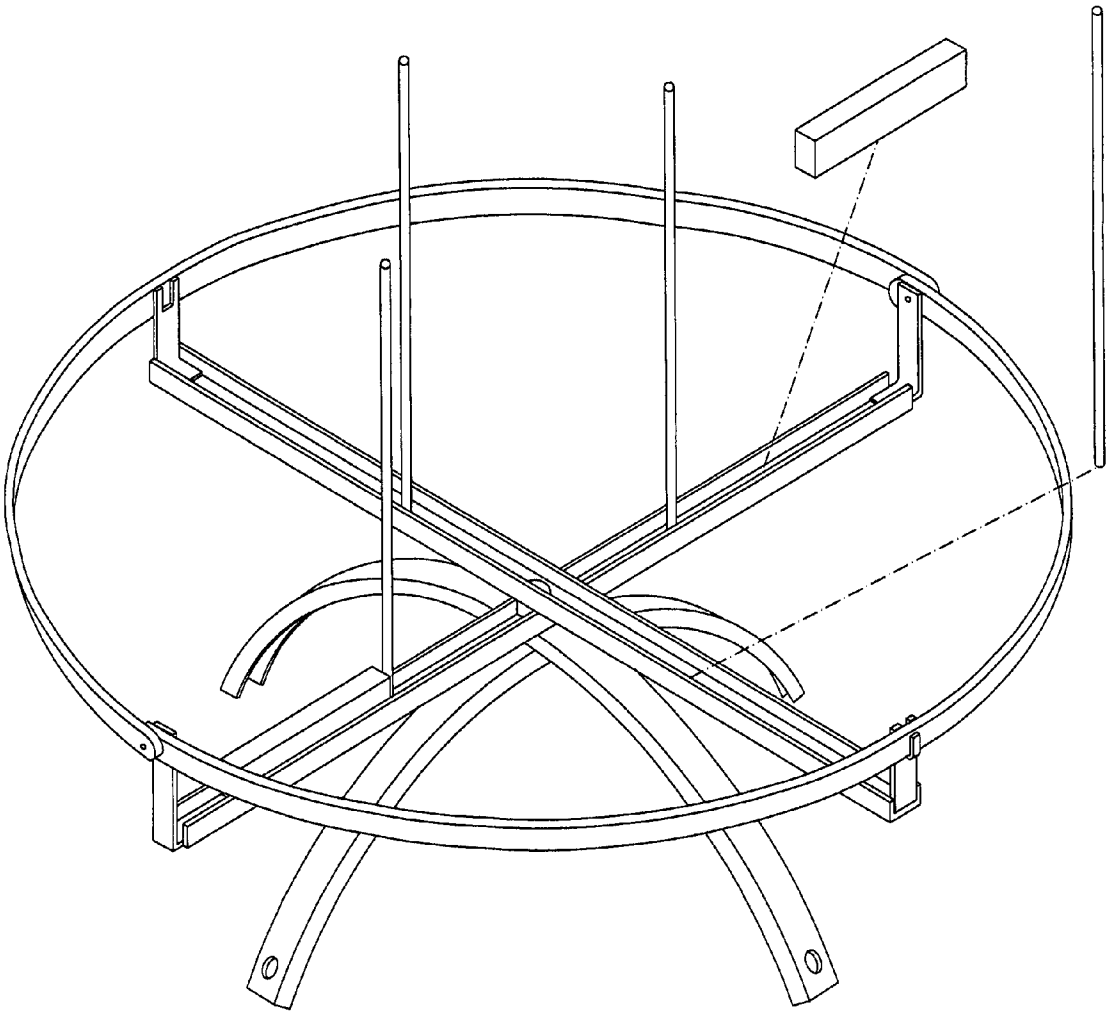

FIG. 5 shows a second embodiment of the dispenser in the open or working position (isometric)

Figure 6:
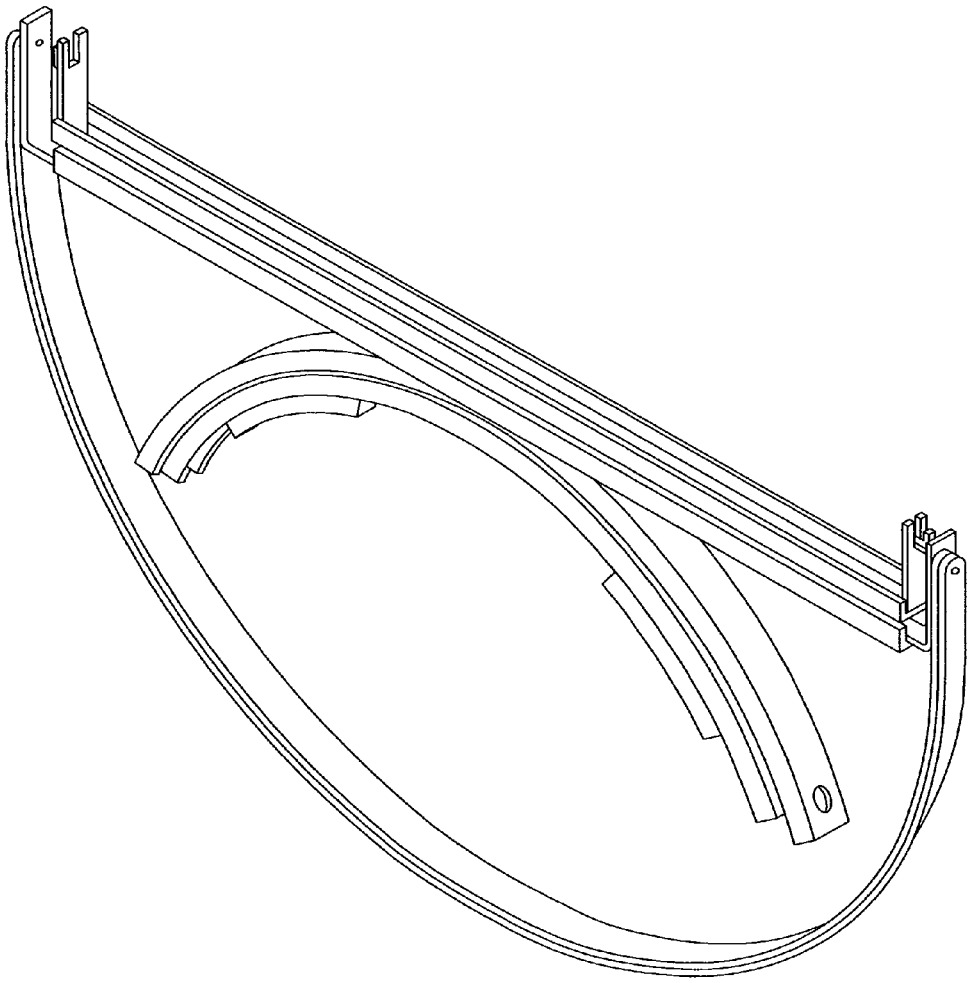

FIG. 6 shows the second embodiment in the closed or storage position (isometric)

Figure 7:
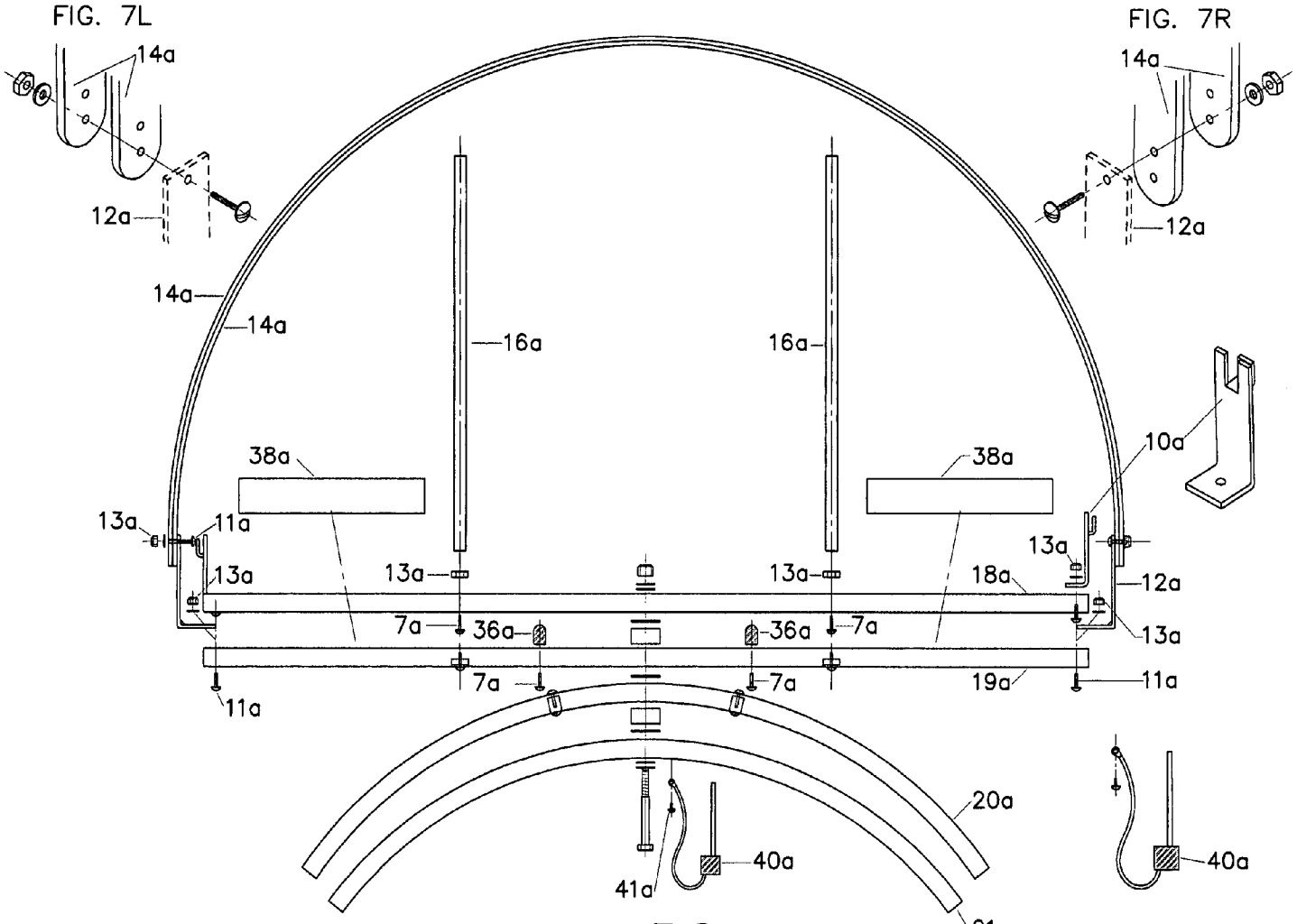

FIG. 7 shows the second embodiment (exploded elevation)

FIG. 7 L shows the rail attachment holes on the left side (exploded isometric)

FIG. 7 R shows the rail attachment on the right side (exploded isometric)

Figure 8:
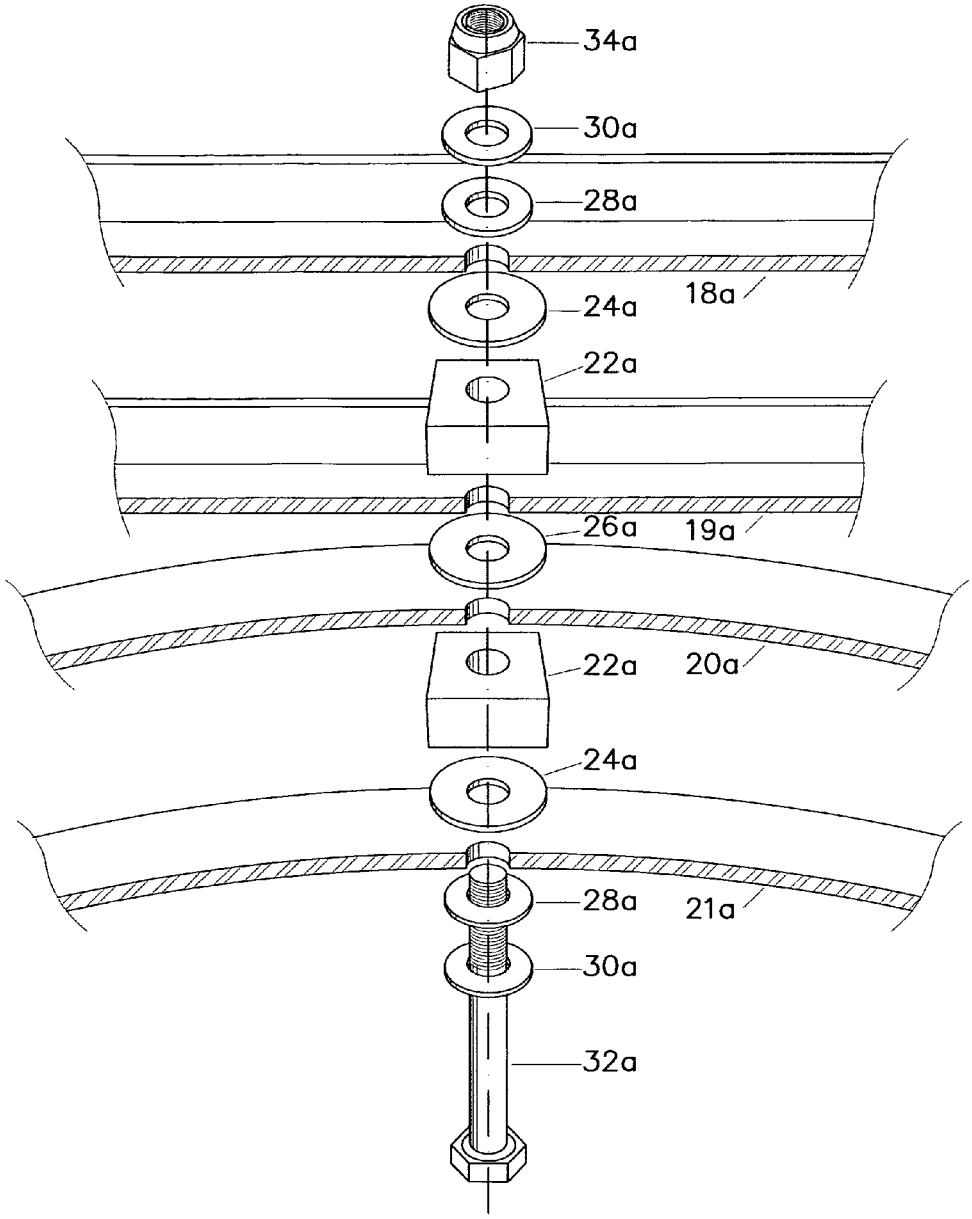

FIG. 8 shows the axis assembly of the second embodiment (exploded isometric-sectional)

Figures 9, 9A:
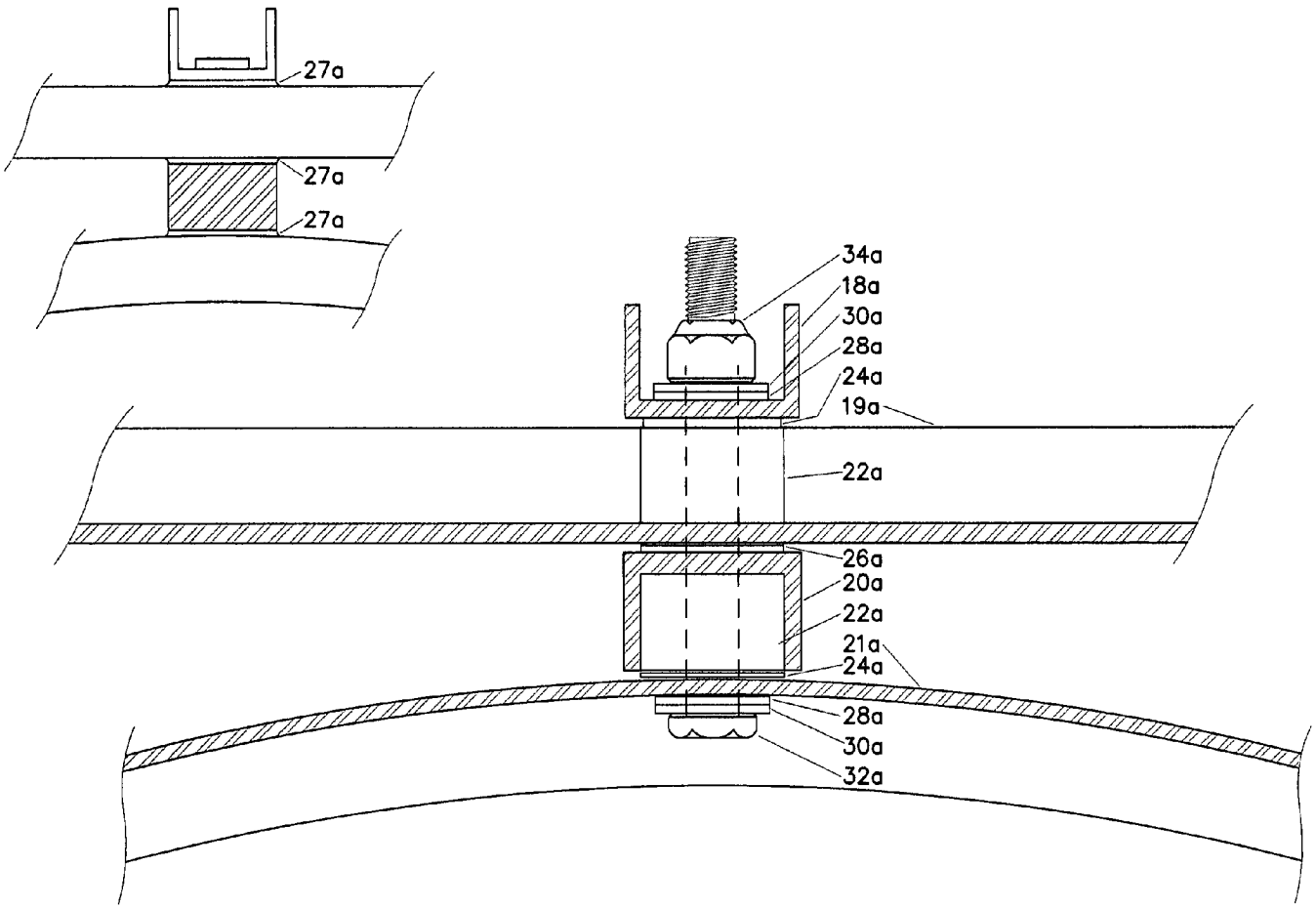

FIG. 9 shows the axis assembly of the second embodiment (elevation-sectional)

FIG. 9*a* shows the axis assembly with protrusions as bearing elements (elevation)

Figure 10:
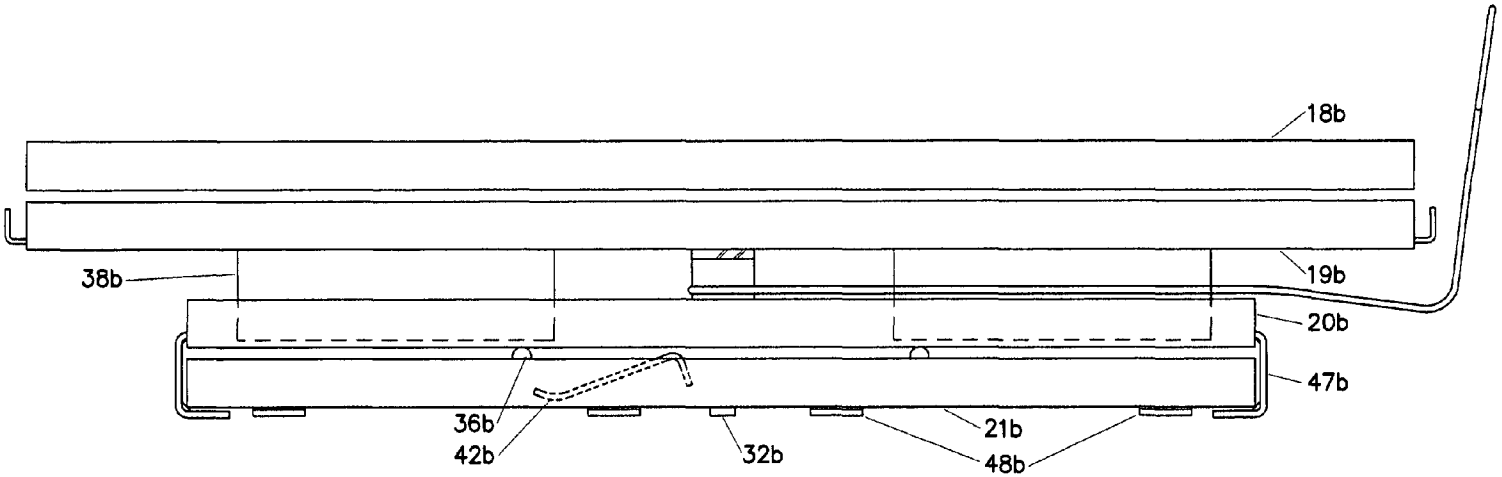

FIG. 10 shows a third embodiment in the closed or storage position (elevation)

Figure 11:
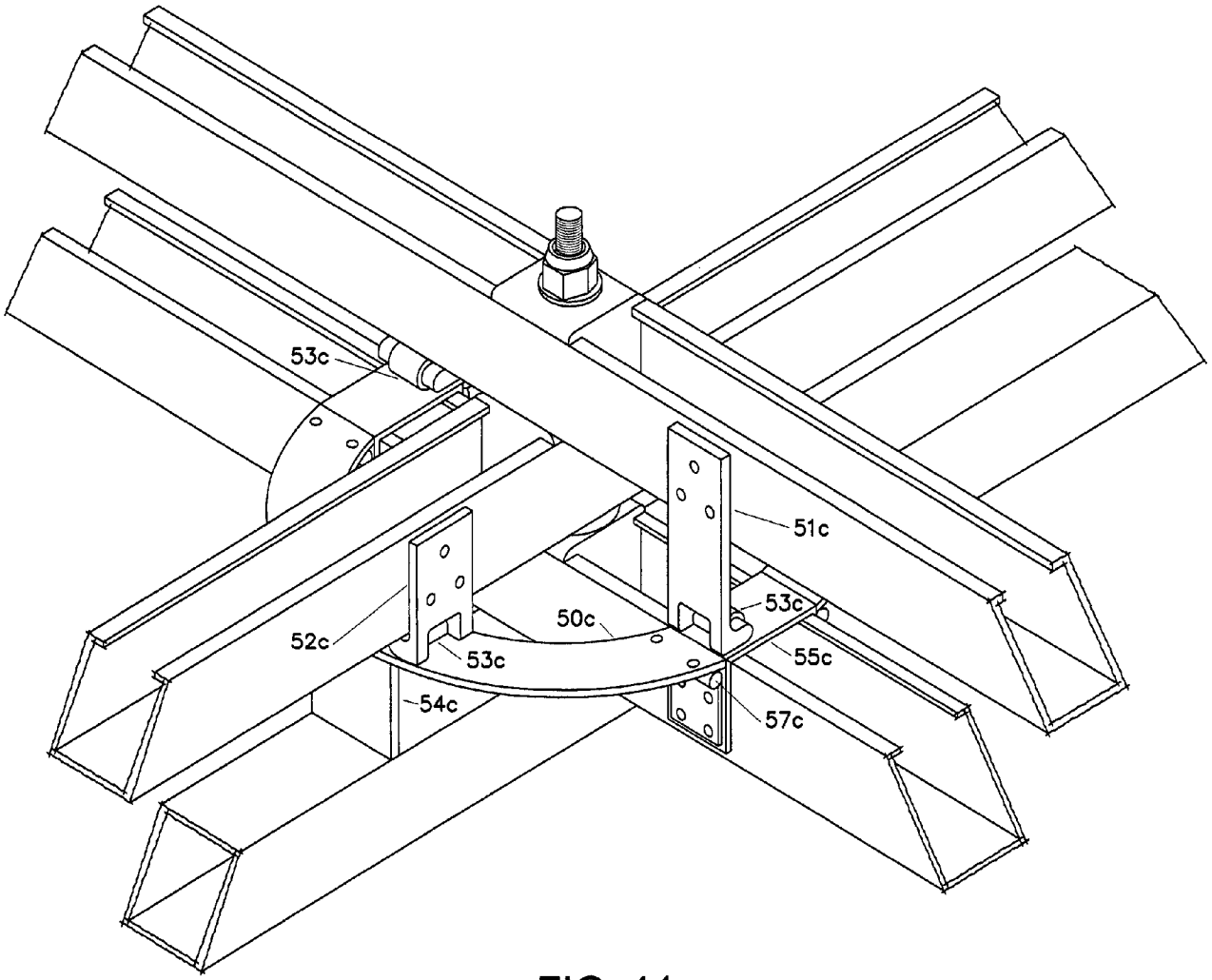

FIG. 11 shows the optional roller track (isometric)

Figure 12:
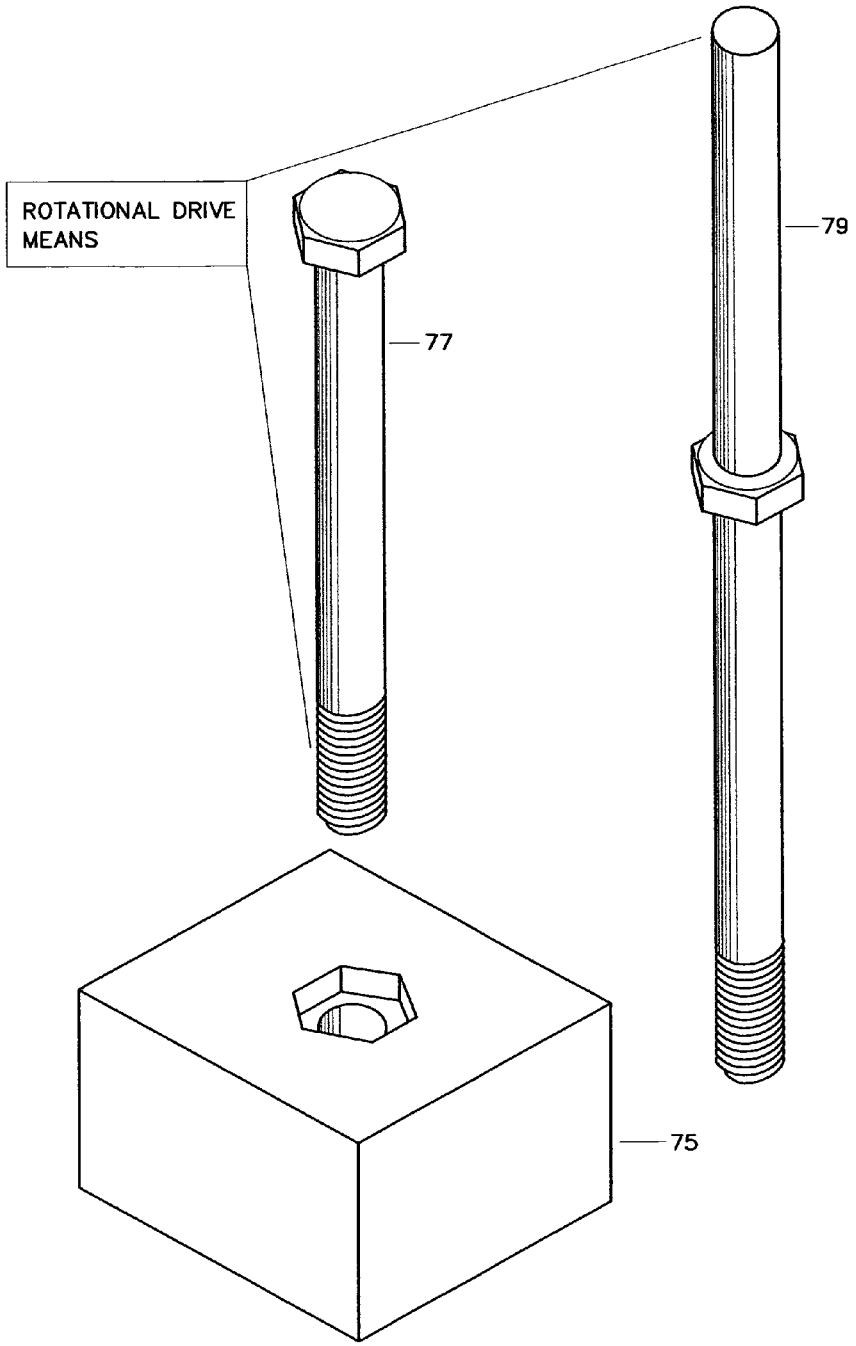

FIG. 12 shows the optional hex spacer (isometric)

FIG. 13 shows the protrusion/indent locking of the optional component lock (isometric)

FIG. 13*a* shows the upper surface of the lower adjoined arm or leg component (isometric)

FIG. 13*b* shows the undersurface of the upper arm or leg component (isometric)

FIG. 14 shows the operation of optional component lock (elevation)

FIG. 14*a* shows the optional component lock in the open perpendicular position (elevation)

FIG. 14*b* shows the optional component lock in the closed parallel position (elevation)

Figure 15:
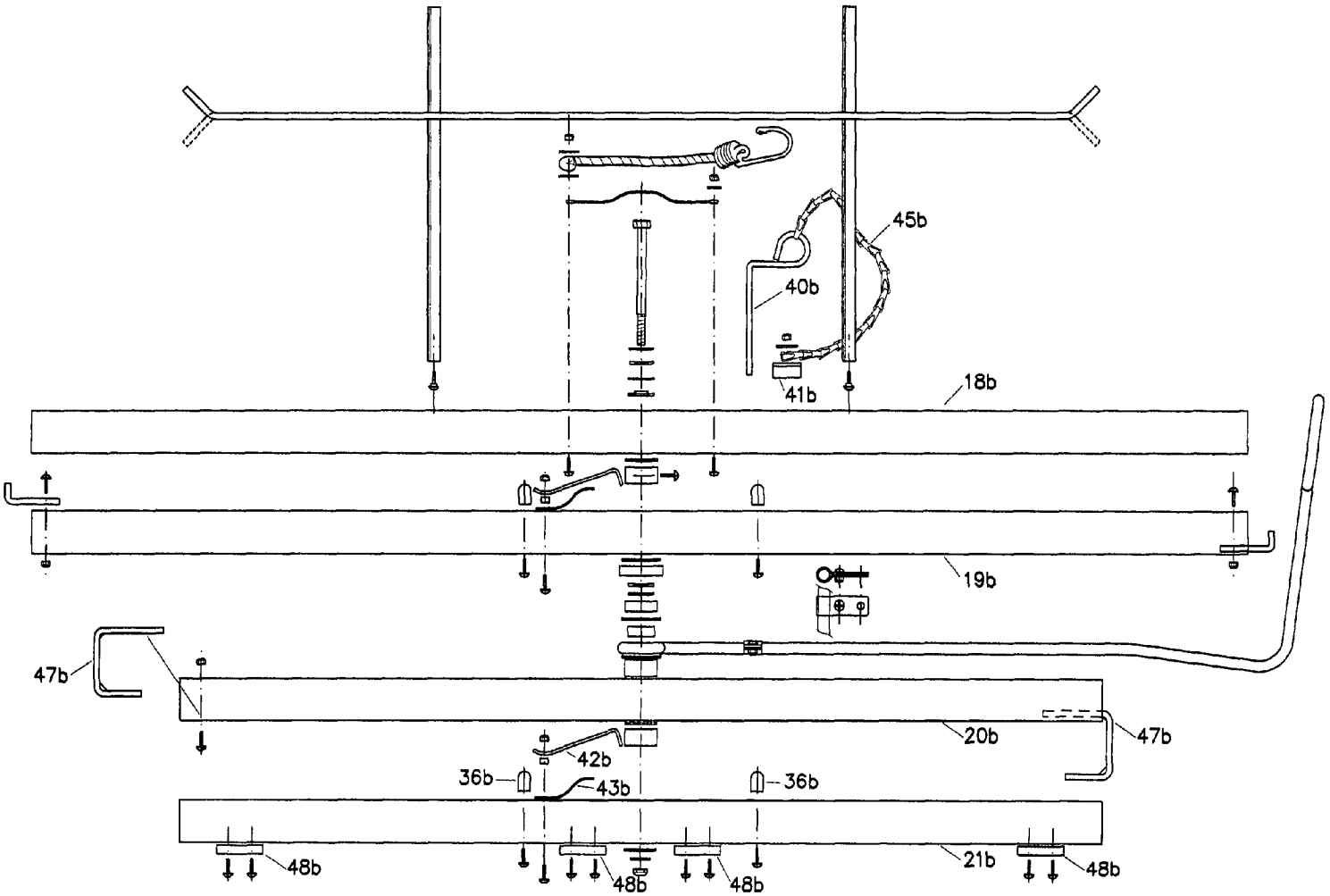

FIG. 15 shows the third embodiment (exploded elevation)

Figure 16:
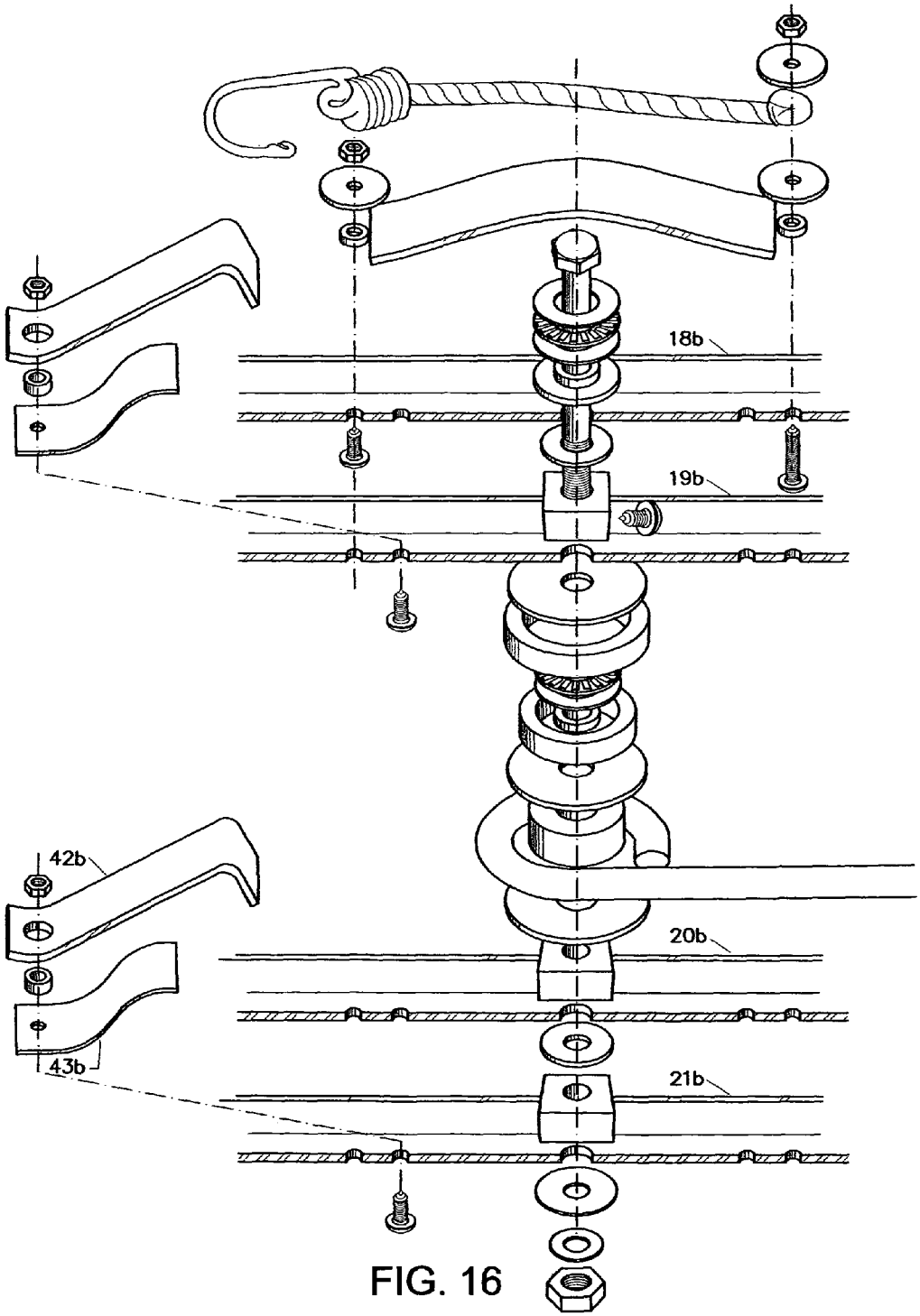

FIG. 16 shows the axis assembly of the third embodiment (exploded isometric-sectional)

Figure 17:
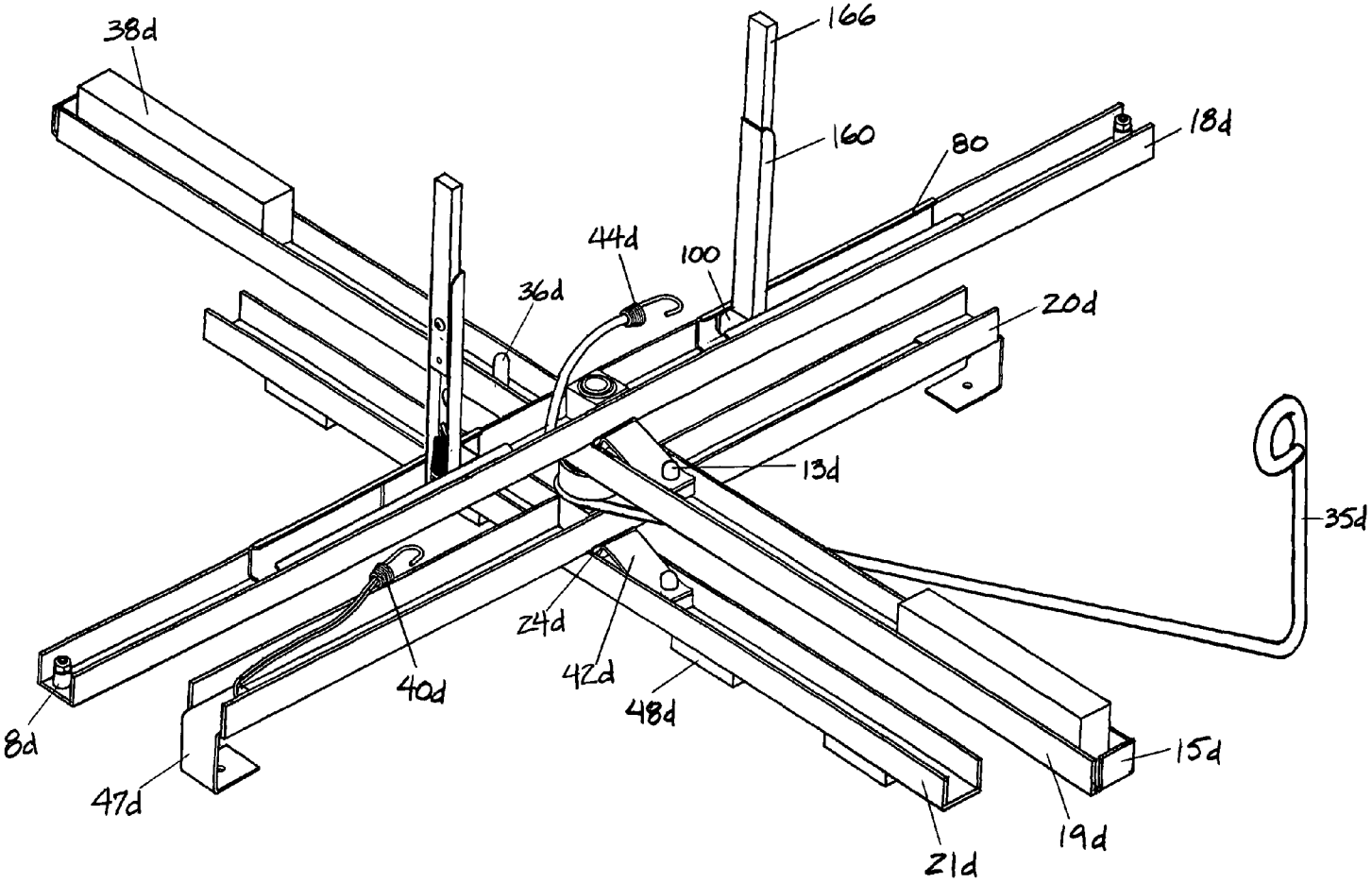

FIG. 17 shows the fourth embodiment in the open perpendicular position (isometric)

Figure 18:
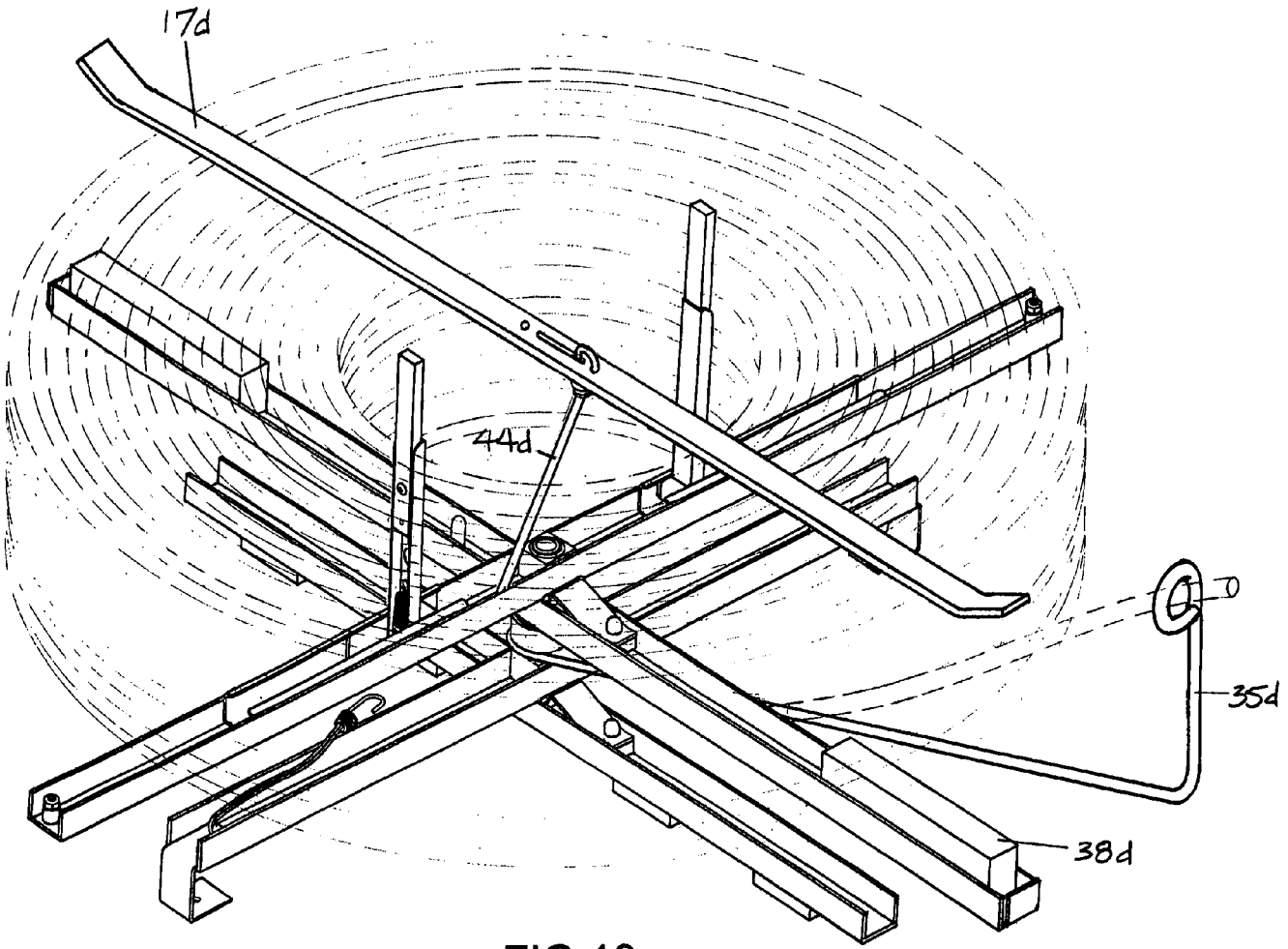

FIG. 18 show the fourth embodiment with a roll of coiled material (isometric)

Figures 19, 19A:
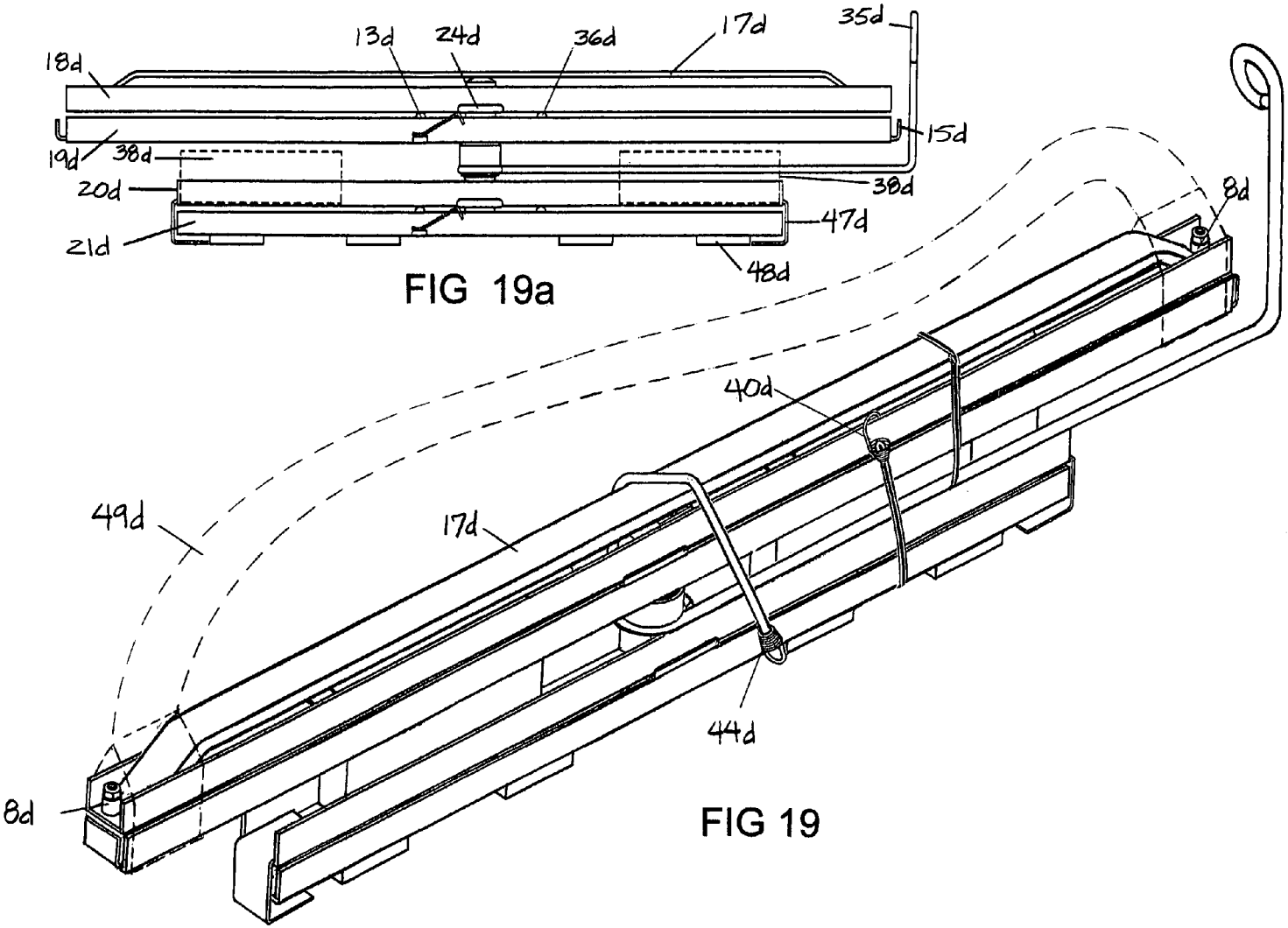

FIG. 19 shows the fourth embodiment in the closed parallel position (isometric)

FIG. 19*a* shows the fourth embodiment in the closed parallel position (elevation)

Figure 20:
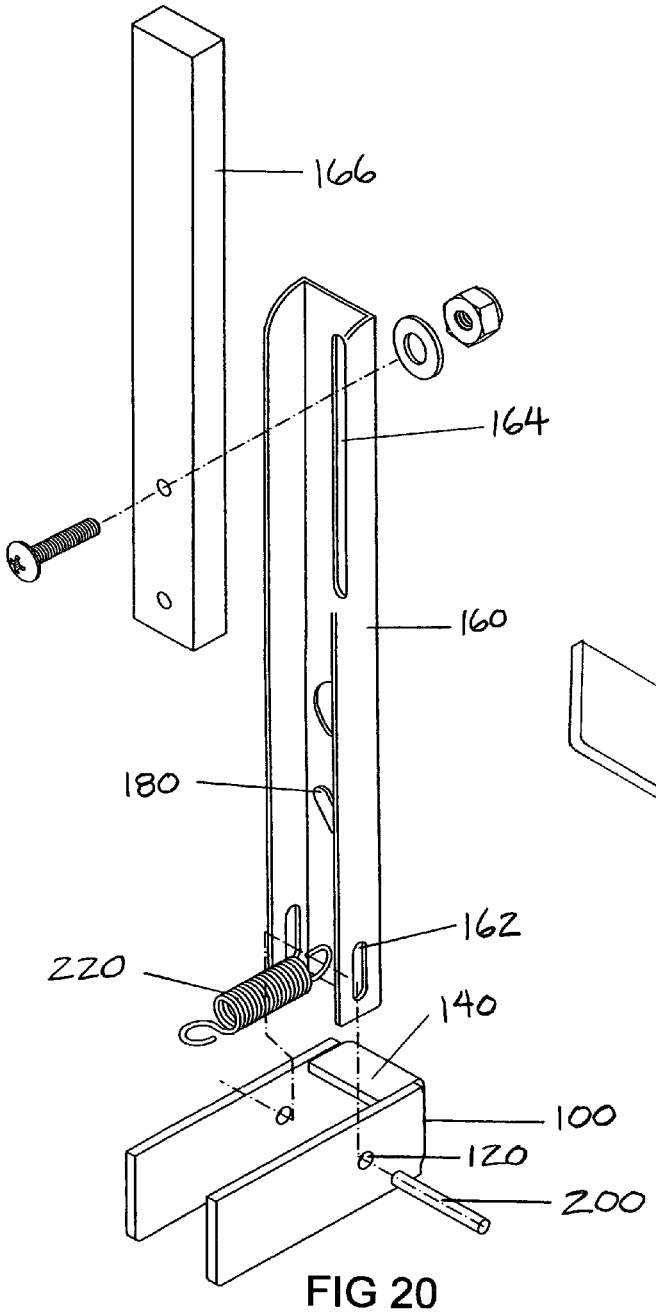

FIG. 20 shows the adjustable guide assembly (exploded isometric)

Figure 21:
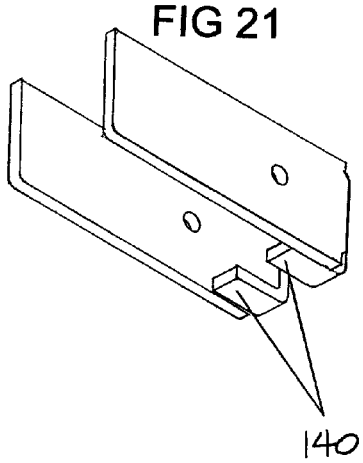

FIG. 21 shows the lower flap of the slider element

FIG. 22 shows the adjustable guide assembly placed within a retainer (exploded isometric)

FIG. 23 shows the channel post lowering into the storage position (isometric).

Figure 24:
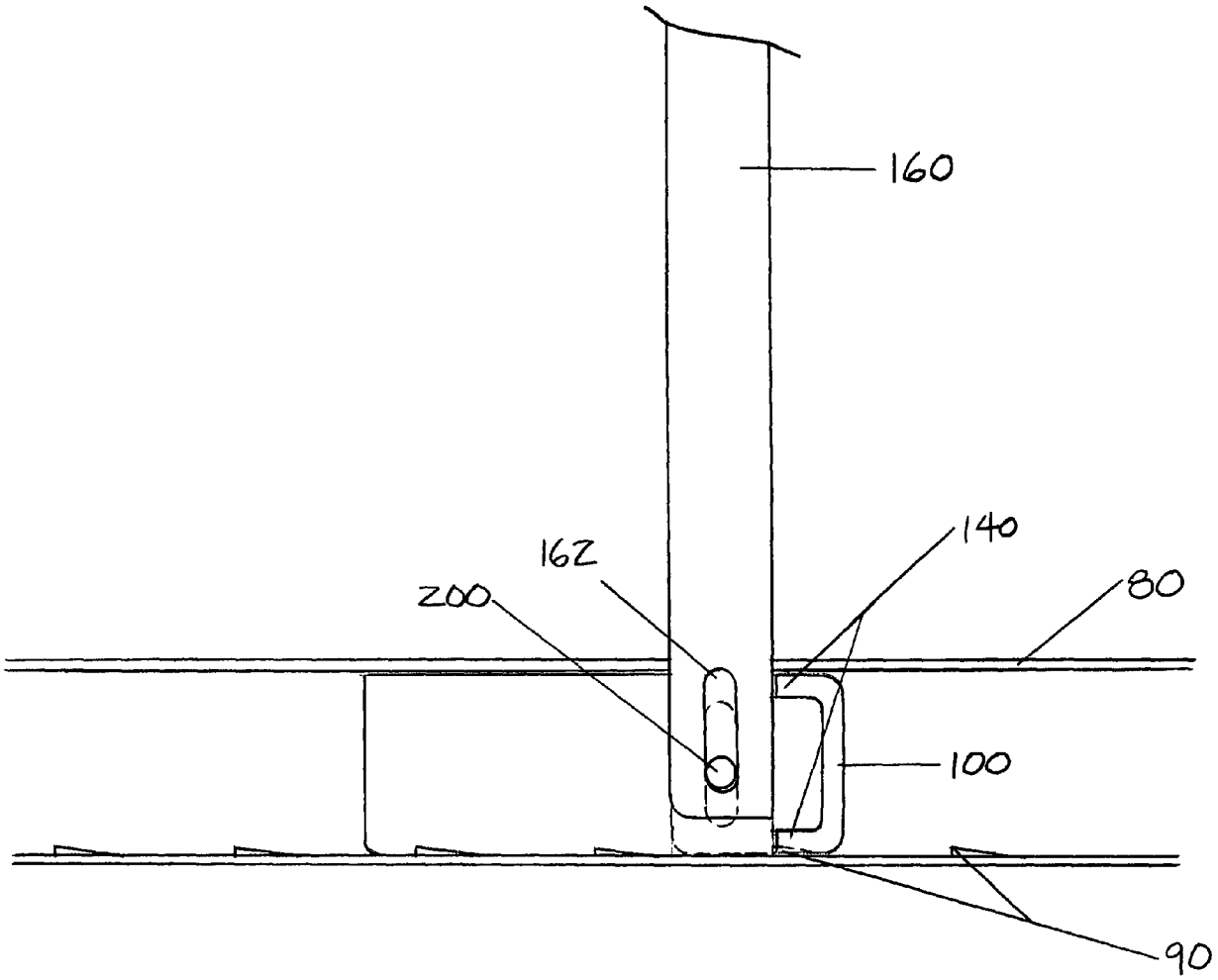

FIG. 24 shows the channel post in the open position (sectional side elevation)

Figure 25:
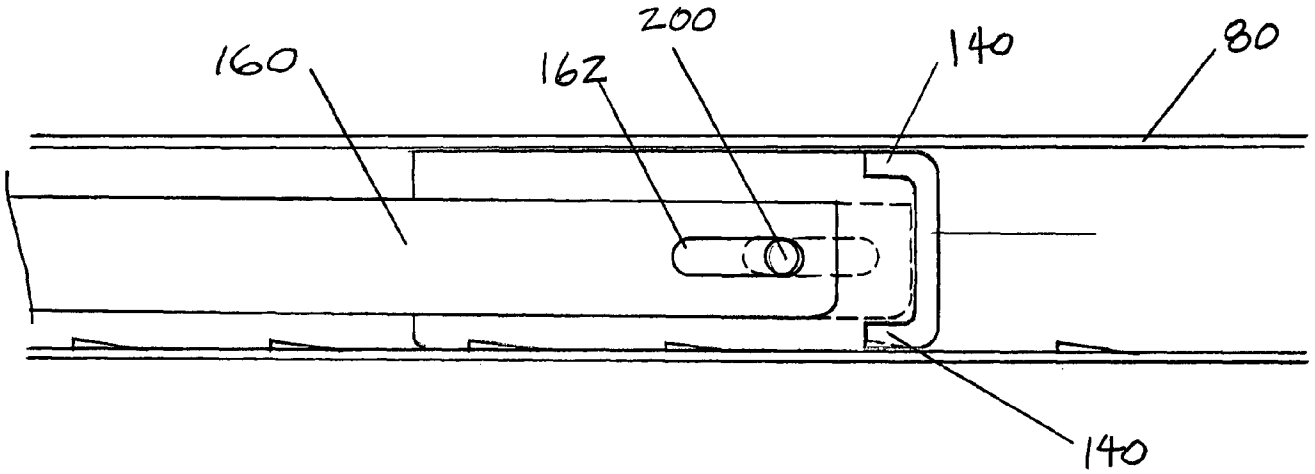

FIG. 25 shows the channel post in the storage position (sectional side elevation)

Figure 26:
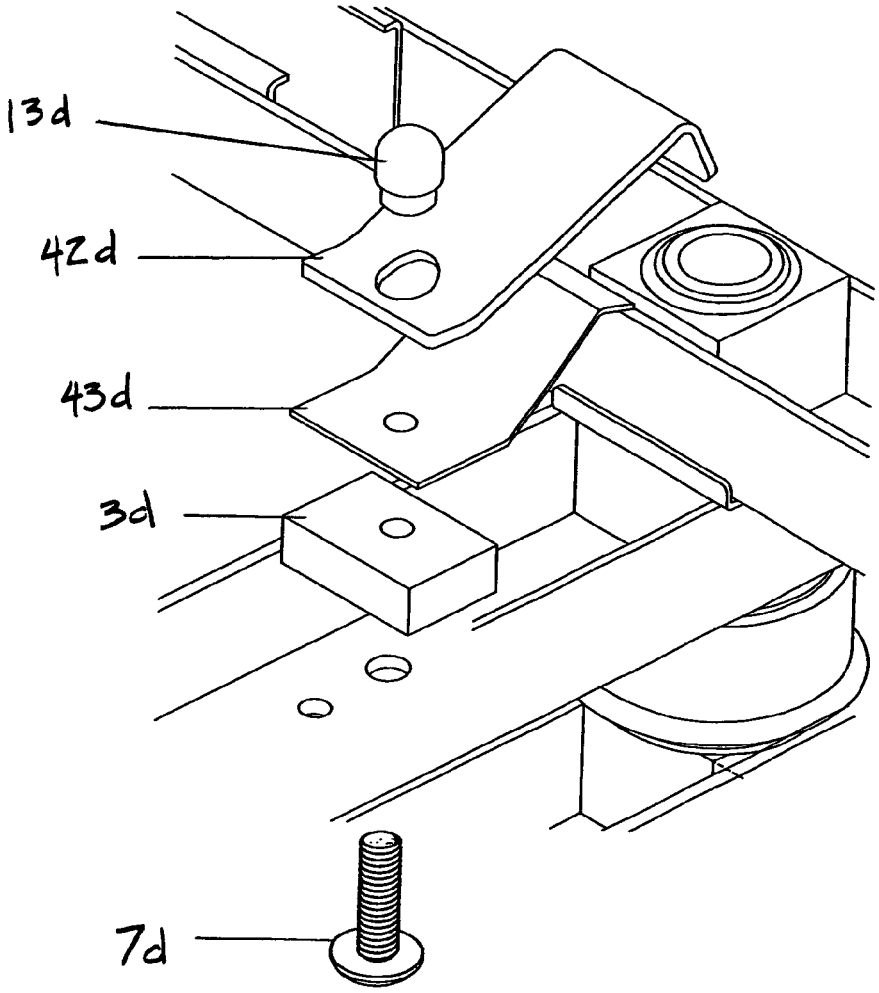

FIG. 26 shows the lock element assembly (exploded isometric)

Figure 27:
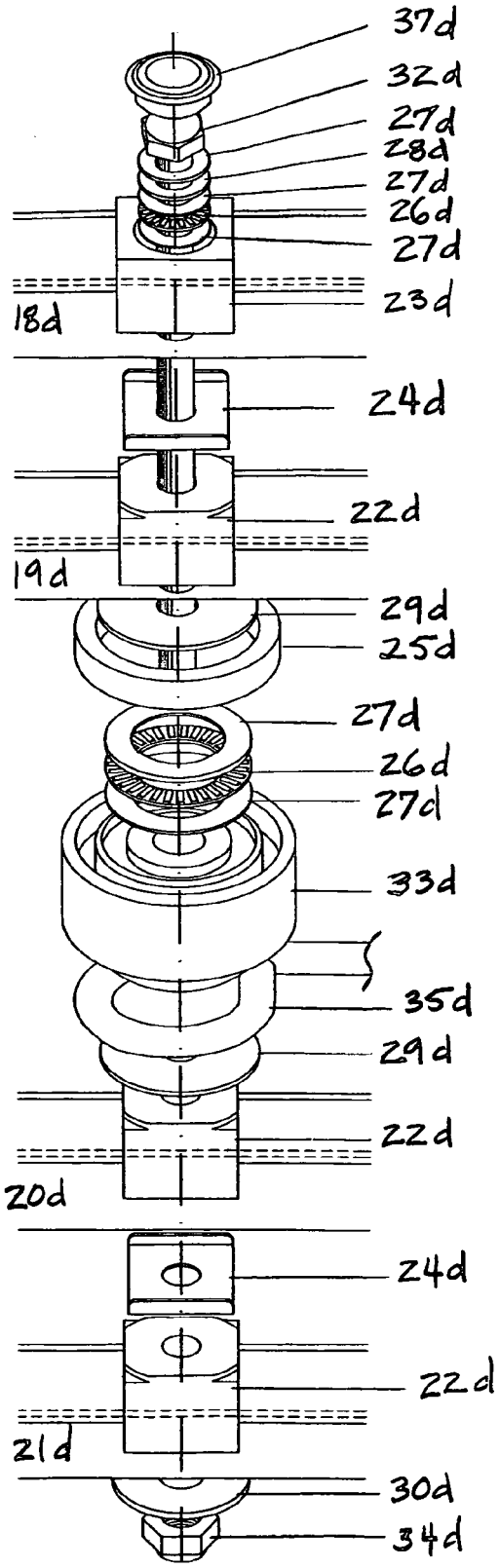

FIG. 27 shows the axis assembly (exploded isometric)

REFERENCE NUMERALS IN DRAWINGS

First Embodiment

15 end bracket
16 post
17 top bar
18 upper arm
19 lower arm
20 upper leg
21 lower leg
36 closing guide
39 lock clip
40 lock pin
41 pin retainer
42 hinge lock
43 spring
44 shock cord assembly
45 chain
4 friction brake screw
5 carriage head screw
6 fender washer
7 screw
8 stand off
9 washer
13 nut

(Axis assembly—First embodiment)

37 upper bearing seal
32 steel bolt
30 steel washer
26 thrust ball bearing
27 hardened steel washer
23 upper bearing holder
24 brass washer
22 spacer
29 1½" steel washer
33 lower bearing holder
25 lower bearing seal
31 round spacer
35 tubing guide
28 nylon washer
34 nylon-type lock nut

Second Embodiment

7*a* screw
11*a* screw
10*a* rail cradle support
12*a* rail hinge support
13*a* nut
14*a* rail
16*a* post
18*a* upper arm
19*a* lower arm
20*a* upper leg
21*a* lower leg
36*a* closing guide
38*a* coil support
40*a* tension lock pin assembly
41*a* retainer screw

(Axis assembly—Second Embodiment)

32*a* steel bolt
30*a* steel washer
28*a* nylon washer
24*a* brass washer
22*a* spacer
26*a* Teflon washer
27*a* protrusion

34*a* nylon-type lock nut

Third Embodiment

18*b* upper arm
19*b* lower arm
20*b* upper leg
21*b* lower leg
32*b* steel bolt
36*b* closing guide
38*b* coil support
40*b* lock pin
41*b* pin retainer
43*b* spring
42*b* hinge lock
45*b* chain
47*b* foot
48*b* foot pad (Optional Roller Track)

50*c* roller track
51*c* roller element
52*c* roller element
53*c* roller
54*c* support element
55*c* connecting elements
57*c* hinge (Optional Component Lock)

61 major indent
63 minor indent
65 protrusion
67 spring (Optional Hex Shaft Member)

75 hex spacer
77 axial bolt
79 extended shaft member

Fourth Embodiment

3*d* lock spacer
7*d* screw
8*d* stand off
13*d* dome nut
15*d* end bracket
17*d* top bar
18*d* upper arm
19*d* lower arm
20*d* upper leg
21*d* lower leg
36*d* closing guide
38*d* coil support
40*d* shock cord lock
42*d* lock element
43*d* spring
44*d* shock cord tensioner
47*d* foot
48*d* foot pad (Axis Assembly—Fourth Embodiment)

37*d* upper bearing seal
32*d* steel bolt
26*d* thrust ball bearing
27*d* hardened steel washer
28*d* nylon washer
23*d* upper bearing holder
24*d* strikeplate
22*d* spacer
29*d* 1½" steel washer
33*d* lower bearing holder
25*d* lower bearing seal
35*d* tubing guide
28*d* nylon washer
30*d* steel washer
34*d* nylon-type lock nut (Adjustable Guide Member)

80 retainer channel
90 sloped tab
100 slider element
120 hole
140 flap
160 channel post
162 leg slot
164 centered slot
166 flex post
180 hook tab
200 pin
220 spring Description FIGS. 1 to 4

Figure 1:
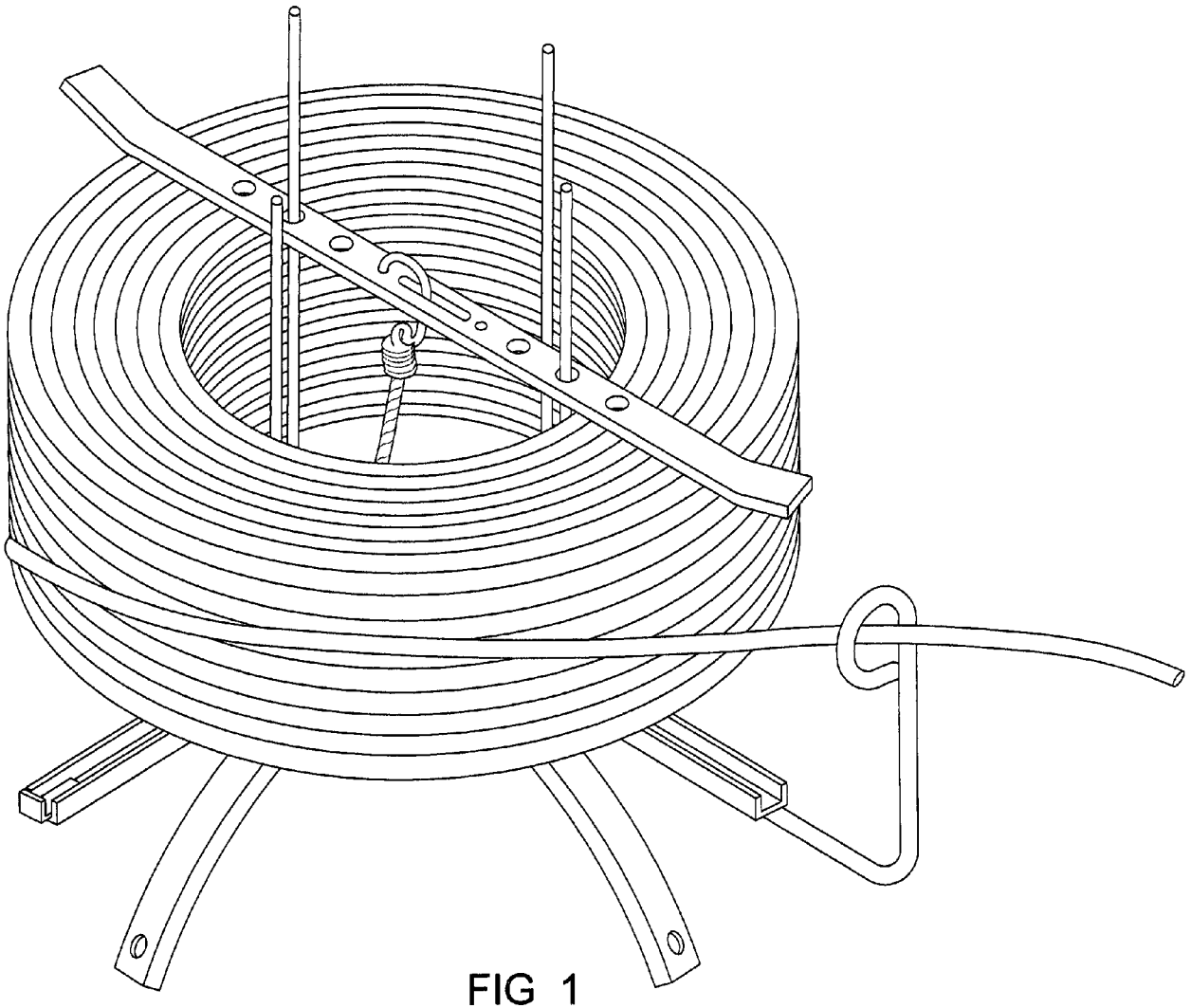
FIG. 1 shows an embodiment of the dispenser with a rolled tube material in place (isometric)

One embodiment of the collapsible reel-type dispenser (here after dispenser) is illustrated in FIG. 1 and FIGS. 2 and 2*a*. A lower leg 21 and an upper leg 20 are joined to a lower arm 19 and an upper arm 18 by an axis assembly (see description below). The preferred material is an aluminum 6061 T-6 sharp cornered U-shaped channel with the following dimensions: 3.18 cm. (1.25 inch) base width, 1.91 cm. (0.75 inch) leg height and 0.32 cm. (0.125 inch) wall thickness. These dimensions will fluctuate according to the load requirements of the given embodiment. Molded plastic composition, wood, graphite fiber, or other material with appropriate load bearing capacity may also be employed.

Upper arm 18 and lower arm 19 are 97.43 cm. (38 inches) in length and are assembled with the channel legs facing up. Upper leg 20 is 87.18 cm. (34 inches) in length, while lower leg 21 is 79.48 cm. (31 inches) in length, and are assembled with the channel legs facing down. Upper leg 20 and lower leg 21 are rolled by special presses to form 46.15 cm. (18 inch) radius and 43.59 cm. (17 inch) radius semicircular sections, respectively. Molded manufacturing techniques would eliminate this process. Holes are stamped with special presses along the longitudinal center line of upper arm 18, lower arm 19, upper leg 20 and lower leg 21 to accommodate the attached member described below (see FIG. 4). Again, molded manufacturing techniques would negate this requirement.

On both sides of the center axis of the inner channel of lower arm 19 is attached the following: a closing guide 36 with a screw 7; closing guide 36 is a 1.90 cm. (0.75 inch) tall cylindrical segment with a half spherical upper extremity. The base of closing guide 36 is threaded to receive screw 7. On one side of the inner channel of lower arm 19 is attached the following parts which collectively function as an arm locking mechanism: A screw 7 is passed in succession through lower arm 19, a spring 43, a stand off 8, a hinge lock 42 and a nut 13. To each extremity of lower arm 19 is attached an end bracket 15.

On both sides of the center axis of the inner channel of upper leg 20 is attached closing guide 36 with screw 7. On one side of the inner channel of upper leg 20 is attached the following parts which collectively function as a leg locking mechanism: Screw 7 is passed in succession through upper leg 20, spring 43, stand off 8, hinge lock 42 and nut 13. Staking holes are located at each extremity of upper leg 20.

On one side of lower leg 21 is attached a lock pin assembly as follows: screw 7 is passed in succession through lower leg 21, a pin retainer 41, a chain 45, a washer 9 and nut 13. To the opposite end of chain 45 is attached a lock pin 40. Lock pin 40 is formed of 0.48 cm (0.188 inch) diameter steel rod. The end portion of lock pin 40 incorporates a bend to follow the angle of the channel floor of lower leg 21 and fit into the gap between the adjacent channel wall and pin retainer 41. Lock pin 40 terminates in a 1" diameter loop to provide a finger hold. Pin retainer 41 is manufactured from spring steel and formed to provide a tensioned gap 0.079 cm (0.031 inch) smaller than the diameter of lock pin 40 when installed onto the inner channel floor of lower leg 21 (not shown). Staking holes are located at each extremity of lower leg 21.

Upper arm 18, lower arm 19, upper leg 20 and lower leg 21 have identically placed holes to receive lock pin 40. These holes are singularly located diagonally opposite on both sides of the center axis of each member and are located tangentially adjacent to the inner channel leg wall rather than along the longitudinal center axis (see FIG. 4).

The axis assembly is comprised as follows: (see FIGS. 2*a*, 3 & 3*a*)

A steel bolt 32 is passed in succession through a steel washer 30, a thrust ball bearing 26, a hardened steel washer 27, an upper bearing holder 23, upper arm 18, a brass washer 24, a spacer 22, lower arm 19, a 1½" steel washer 29, thrust ball bearing 26, hardened steel washer 27, a lower bearing holder 33, 1½ steel washer 29, a round spacer 31, a tubing guide 35, 1½" steel washer 29, upper leg 20, spacer 22, brass washer 24, lower leg 21, a nylon washer 28, steel washer 30 and a nylon-type lock nut 34. Tubing guide 35 is captured by 1½" steel washer 29 above and below as described above so as to be able to rotate freely around round spacer 31.

Spacer 22 incorporates a threaded opening on the side oppositely faced from the locking mechanism of hinge lock 42 and associated parts described above to receive friction brake screw 4. In this embodiment, spacer 22 is made of aluminum 6061 T-6 alloys. Upper bearing holder 23 and lower bearing holder 33 are also manufactured from aluminum 6061, while round spacer 31 is made of Delrin (actual) plastic. Some embodiments might combine lower bearing holder 33 and round spacer 31 into one manufactured piece with a formed ridge substituting for the adjacent 1½" steel washer 29 (not shown).

A lower bearing seal 25 surrounds lower bearing holder 33 and contacts both 1½" steel washer 29 above and below to effectively seal thrust ball bearing 26 from dirt and moisture. An upper seal 37 is attached to upper arm 18 by means of screw 7 passed in succession through upper arm 18, stand off 8, a fender washer 6 and nut 13 installed on either end of upper seal 37 so that upper seal 37 is captured between the oppositely installed stand off 8 and fender washer 6 to form a semi parabolic curve up and over thrust ball bearing 26 and related assembly exposed above the upper arm 18 surface to effectively seal thrust ball bearing 26 from dirt and moisture. In this embodiment, lower bearing seal 25 is manufactured from neoprene sponge foam, while upper seal 37 is manufactured out of VHMWPE [Very High Molecular Weight Polyethylene).

One screw 7 of the preceding assemblage is of sufficient height so as to accommodate the attachment of a shock cord assembly 44 as follows: screw 7 passes in succession through upper arm 18, stand off 8, fender washer 6, the eyehole end of shock cord assembly 44, a second fender washer 6, and nut 13. Shock cord assembly 44 is comprised of an approximately 15.2 cm (6 inches) shock cord with a hook attachment on one end and an eyehole on the other.

A post 16 is threaded on one end to receive a carriage head screw 5 so as to be optionally attached to placement holes located in three hole groupings on both sides of upper arm 18 and lower arm 19, a total of four post 16 thereby installed concurrently. The placement holes are of a keyhole shape with round openings 1.59 cm (0.625 inch) tangentially intersecting square openings 0.79 cm (0.312 inch) so that the round head portion of carriage head screw 5 is able to pass through the round hole openings and the square profile section of carriage head screw 5 is able to fit into the square opening (see FIG. 4).

A top bar 17 is an aluminum bar measuring 2.54 cm (1 inch) wide, 91.4 cm (36 inches) long and 0.635 cm (0.25 inch) thick. The last 2.54 cm (1 inch) of each end of top bar 17 is angled at approximately 45 degrees. Various holes and openings are located on the longitudinal centerline of top bar 17 (see FIG. 1) as follows: A 4.45 cm (1.75 inch) long by 0.64 cm (0.25 inch) slot is centrally located along the length of top bar 17. Two 0.95 cm (0.375 inch) diameter holes are located 4.45 cm (1.75 inch) on either side of the center point of top bar 17. Three 1.43 cm diameter holes (0.563 inch) are coaxially located along the center line of top bar 17 exactly corresponding to the square hole positions located on upper arm 18 and lower arm 19 described herein (see FIG. 4).

A lock clip 39 is reversely mated to a second lock clip 39 around and attached to tubing guide 35 with screw 7 and nut 13. A hole is located on lock clip 39 to receive screw 7 and nut 13. A second hole is located towards the end extremity of lock clip 39 to allow lock pin 40 to pass through. The lock clip 39 pairing is installed onto tubing guide 35 so that the outer hole to receive lock pin 40 is in alignment with the previously described holes located tangentially adjacent to the inner channel leg wall on both sides of the center axis of upper arm 18, lower arm 19, upper leg 20 and lower leg 21.

Operation

The operation of the dispenser is as follows (starting with the closed or storage position): To open the dispenser, the hook end of shock cord assembly 44 is detached from the finger hold loop of lock pin 40, releasing top bar 17 from it's storage position; top bar 17 is temporarily set aside. Lock pin 40 is removed from the alignment holes located on upper arm 18, lower arm 19, paired lock clip 39, upper leg 20 and lower leg 21, effectively unlocking the arm and leg members and closing guide 36 to rotate freely around the axial assembly. Lower leg 21 is rotated perpendicular to upper leg 20, allowing hinge lock 42 to lift up into position against lower leg 21 by means of spring 43, effectively locking the combined leg members as a single lower assemblage and so combined form the dispenser base. Each leg may be secured to the ground with a stake (not shown) placed through a hole provided in each leg extremity.

Lower arm 19 is rotated perpendicular to upper arm 18, allowing hinge lock 42 to lift up into position against upper arm 18 by means of spring 43, effectively locking the combined arm members as a single upper assemblage. Thrust ball bearing 26 are located above and below the so combined arm members and thereby allow the free rotation of the single upper assemblage in the open position and thus provide a rotary material support upon which material to be dispensed is placed.

One post 16 is attached to each side of upper arm 18 and lower arm 19, a total of four (4) post 16 are thus employed to collectively serve as an inner diameter guide for the of spooled material as follows: carriage head 5 is threaded into the bottom of each post 16; the round head portion of carriage head screw 5 is passed through the round section of the keyhole shaped placement holes located on each side of upper arm 18 and lower arm 19. Post 16 is then slid back towards the center axial assemblage so that the square profile section of the carriage head bolt engages and fits into the square profile section of the keyhole shaped placement hole. Post 16 is then grasped and twisted in a clockwise direction to tighten the carriage head screw and thereby secure post 16 to the arm member.

The roll of material to be dispensed is placed upon the combined arm member upper assemblage with the plurality of post 16 radially positioned adjacent to the inner diameter of the rolled material. Top bar 17 is then placed over the post 16 members located on either side of upper arm 18 with the 45 degree angled end portions of top bar 17 facing upwards and lowered onto the top of the roll of material so that the post 16 members pass through the exactly corresponding 1.43 cm (0.563 inch) diameter holes located on either side of top bar 17. The hook end of shock cord assembly 44 is then grasped and pulled upward and through the 4.45 cm (1.75 inch) long by 0.64 cm (0.25 inch) slot centrally located along the length of top bar 17 and shifted longitudinally so as to position the hook end of shock cord assembly 44 to align with and lower into one of the two 0.95 cm (0.375 inch) diameter holes located 4.45 cm (1.75 inch) on either side of the center point of top bar 17. The shock cord assembly 44 thus attached exerts a downward tension upon top bar 17, thus securing the roll of material upon the dispenser and preventing the unwinding coils from lifting up and over post 16 members and thereby fouling the dispenser operation.

Material may be loaded onto the thus configured dispenser and reeled out by pulling the end of the spooled roll through the looped end of the tubing guide 35 and proceeding. Tubing guide 35 directs the tubing off the roll downward to help prevent fouling and may rotate in any direction around the dispenser as required (see FIG. 1). To load a replacement roll of material, shock cord assembly 44 is detached from top bar 17, which is then removed and temporarily set aside. A new roll is installed in place, top bar 17 is re-installed and shock cord assembly 44 re-attached as before.

Stakes (not shown) may be inserted through the 0.95 cm (0.375 inch) diameter holes located near the terminals of upper leg 20 and lower leg 21 as required. The termination of each curved channel of the two leg components serves as a spade to help secure the dispenser in place on soil surface.

To close the dispenser, the hook end of shock cord assembly 44 is detached from top bar 17 and top bar 17 is removed and temporarily set aside. Post 16 members are removed by twisting in a counter-clockwise direction to loosen carriage head screw 5, thus releasing the post 16 members from the arm members. Post 16 are stored in pairs of two on either side of lower arm 19 within the inner channel walls, end bracket 15 serves to retain the post members therein. Hinge lock 42 on lower arm 19 is depressed so as to disengage contact with upper arm 18 and allow lower arm 18 to rotate from the open perpendicular position into the closed parallel position, directly aligned with upper arm 19. Hinge lock 42 on upper leg 20 is depressed so as to disengage contact with lower leg 21 and allow upper leg 20 to rotate from the open perpendicular position into the closed parallel position, directly aligned with lower leg 21. The dispenser is then held with all arm and leg members in parallel alignment. Tubing guide 35 is rotated into position on either side of the axial assembly and parallel with the arm and leg members thus situated so that the hole to receive lock pin 40 on lock clip 39 is aligned with the consecutive holes located on either side of the center axis tangentially adjacent to the inner channel leg wall of the arm and leg members. Lock pin 40 is then inserted in consecutive order from below through lower leg 21, upper leg 20, paired lock clip 39, lower arm 19 and upper arm 18. When fully inserted thusly, lock pin 40 is frictionally secured in the gap between the adjacent channel wall and pin retainer 41.

Top bar 17 is recovered and secured upon the top of upper arm 18 as follows: the 45 degree angled end sections of top bar 17 are positioned facing downward and fitting inside the channel walls of upper arm 18 with shock cord assembly 44 protruding from the gap thus created between the lowermost surface of top bar 17 thus situated and the upper most surface of the channel leg wall of upper leg 18. The hook end of shock cord assembly 44 is then stretched over the top of top bar 17 and downward below lower leg 21 and attached onto the finger pull loop of lock pin 40, thus securing top bar 17 upon the upper arm as well as tensioning lock pin 40 toward the channel floor and thereby further securing lock pin 40 in the storage position.

Description (Second Embodiment) FIGS. 5 to 9

A second embodiment of the dispenser is illustrated in FIG. 7 and FIG. 8: A lower leg 21*a* and an upper leg 20*a* are joined to a lower arm 19*a* and an upper arm 18*a* by an axis assembly (see description below). The preferred material is an aluminum 6061 T-6 sharp cornered U-shaped channel with the following dimensions: 3.18 cm. (1.25 inch) base width, 1.91 cm. (0.75 inch) leg height and 0.32 cm. (0.125 inch) wall thickness. These dimensions will fluctuate according to the load requirements of the given embodiment. Molded plastic composition, wood, graphite fiber, or other material with appropriate load bearing capacity may also be employed.

Upper arm 18*a* and lower arm 19*a* are 97.43 cm. (38 inches) in length and are assembled with the channel legs facing up. Upper leg 20*a* is 87.18 cm. (34 inches) in length, while lower leg 21*a* is 79.48 cm. (31 inches) in length, and are assembled with the channel legs facing down. Upper leg 20*a* and lower leg 21*a* are rolled by special presses to form 46.15 cm. (18 inch) radius and 43.59 cm. (17 inch) radius semicircular sections, respectively. Molded manufacturing techniques would eliminate this process. Holes (not shown) are stamped with special presses along the longitudinal center line of upper arm 18*a*, lower arm 19*a*, upper leg 20*a* and lower leg 21*a* to accommodate the attached member described below. Again, molded manufacturing techniques would negate this requirement.

To each upper arm 18*a* extremity is attached a rail cradle support 10*a* with a screw 11*a* and a nut 13*a*. The upper extremity of rail cradle support 10*a* is equally divided into three vertically projecting appendages, the center appendage offset outward to form a cradle. On both sides of the center axis of upper arm 18*a* is attached one or more pair of a nut 13*a* and a screw 7*a*. The threads of screw 7*a* protrude above the floor surface of upper arm 18*a* to receive a post 16*a*, post 16*a* being tapped and threaded accordingly to fit upon the projecting threads of screw 7*a*. To each lower arm 19*a* extremity is attached a rail hinge support 12*a* with screw 11*a* and nut 13*a*. Rail hinge support 12*a* is a bracket member with a hole in the upper vertical center section. To each rail hinge support 12*a* is attached one end of a pair of a rail 14*a* with screw 11*a* and nut 13*a* in the following manner (see FIG. 7):

Two holes are located on the center line of each rail 14*a* extremity. One pair of rail 14*a* ends are attached to one rail hinge support 12*a* through the end most holes (FIG. 7L). The oppositely attached pair of rail 14*a* ends is attached to the remaining rail hinge support 12*a* through the end most hole of the outermost rail 14*a* and the innermost hole of the inner rail 14*a* so paired (FIG. 7R). Rail cradle support 10*a* and rail hinge support 12*a* rise from their respective arm attachment points to an equal height above the uppermost surface of upper arm 18*a*, in this embodiment that being 5.77 cm. (2.25 inches). Rail hinge support 12*a* and rail cradle support 10*a* could be essentially replaced by elements formed from the associated arm components themselves, such as with molded manufacture or stamped metal work, lower arm 19*a* having hinge location points on the arm extremities and upper arm 18*a* having formed element on the arm extremities having at least one formed appendage (not shown).

On both sides of the center axis of lower arm 19*a* is attached the following: one or more pair of nut 13*a* and screw 7*a* with the threads of screw 7*a* protruding above the floor surface of lower arm 19*a* to receive post 16*a*; a closing guide 36*a* with a screw 7*a*; a coil support 38*a*. Closing guide 36*a* is a 1.90 cm. (0.75 inch) tall cylindrical segment with a half spherical upper extremity. The base of closing guide 36*a* is threaded to receive screw 7*a*. Coil support 38*a* is placed upon lower arm 19*a* in the working or open mode and is stored underneath lower leg 21*a* in the storage closed mode (see FIGS. 6 & 7). Coil support 38*a* is 20.32 cm. (8 inches) long, 2.86 cm. (1.13 inches) wide and 4.45 cm. (1.75 inches) tall. Coil support 38*a* is 0.32 cm. (0.125 inches). wider than the inner width of lower arm 19*a* and lower leg 21*a*.

On both sides of the center axis of the upper leg 20*a* is attached closing guide 36*a* with screw 7*a*. Staking holes are placed at each extremity of upper leg 20*a* and lower leg 21*a*.

Coil support 38*a* is comprised of dense polyurethane foam, though any material possessing similar compressibility and load bearing qualities could be employed. In this embodiment, with the exception of rail 14*a* and closing guide 36*a*, the preferred material of the components herein described is an aluminum 6061 T-6 alloy. Rail 14*a* and closing guide 36*a* are composed of ABS (acrylonitrile butadiene stryene) and Delrin (actual) plastic, respectively. Again, depending on the embodiment and specific application, molded plastic compositions, wood, graphite fiber, or other material with sufficient inherent structural capacity may be substituted.

The axis assembly is comprised as follows: (see FIG. 8 and FIG. 9)

A steel bolt 32*a* is passed in succession through a steel washer 30*a*, a nylon washer 28*a*, lower leg 21*a*, a brass washer 24*a*, a spacer 22*a*, upper leg 20*a*, a Teflon washer 26*a*, lower arm 19*a*, spacer 22*a*, brass washer 24*a*, upper arm 18*a*, nylon washer 28*a*, steel washer 30*a*, and a nylon-type lock nut 34*a*. In this embodiment, spacer 22*a* is made of aluminum 6061 T-6 alloy. In molded manufacturing techniques, this assemblage would be largely negated by the support and washer components substantially replaced with formed single arm and leg units with a protrusion 27*a* at each main component intersection serving as the bearing surfaces (see FIG. 9*a*).

A tension lock pin assembly 40*a* is attached to the under surface of lower leg 21*a* with a retainer screw 41*a*. Tension lock pin assembly 40*a* consists of a steel dowel 10.25 cm (4 inches) in length and 0.51 cm (0.20 inch) in diameter attached by an aluminum crimp to a 15.38 cm (6 inch) length of small diameter plastic coated steel braided cable. To the other end of the cable is attached an aluminum eye hole connector. The steel dowel member of tension lock pin assembly 40*a* is placed through successive alignment holes (not shown) located 8.89 cm. (3.5 inches) from the centerline and in the channel base of lower leg 21*a*, upper leg 20*a*, lower arm 19*a*, and upper arm 18*a*. The holes are directly adjacent to the inner channel vertical leg wall and in alignment to receive the steel dowel member of tension lock pin assembly 40*a* herein described when the reel type apparatus is in the closed or storage position. Tension lock pin assembly 40*a* is attached with retainer screw 41*a* placed through the aluminum eye hole connector and into an attachment hole (not shown) located 5.72 cm. (2.25 inches) from the lower leg 12*a* under surface center axis on the same side as the alignment hole of lower leg 21*a*. 3.18 cm. (1.25 inches) separate the attachment hole of retainer screw 41*a* and the alignment hole of lower leg 21*a* so that the placement of tension lock pin assembly 40*a* through the successive alignment holes as described above results in a tensioned loop being formed by the plastic coated steel braided cable portion of the tension lock pin assembly 40*a*.

Operation (Second Embodiment)

The operation of the second embodiment of the dispenser is as follows, starting with the closed or storage position (see FIG. 6): To open the dispenser, the rail 14*a* members are grasped and swung upwards 180 degrees (exactly opposite the storage position starting point). The tension lock pin assembly 40*a* is removed from the alignment holes, effectively unlocking the arm and leg members. Lower leg 21*a* is rotated perpendicular to upper leg 20*a*. Lower leg 21*a* and upper leg 20*a* combine to form the dispenser base. Each leg is secured to the ground with a stake (not shown) placed through a hole provided in each leg extremity.

Lower arm 19*a* is rotated perpendicular to upper arm 18*a*. Rail 14*a* members are separately and oppositely lowered each to rest in and upon a rail cradle support 10*a*. Rail 14*a* members are frictionally secured by finger like appendages on the extremity of rail cradle support 10*a*. The joining of rail 14*a* members to rail cradle support 10*a* members effectively locks upper arm 18*a* and lower arm 19*a* together. Along with rail hinge support 12*a* these elements combine to form a semi-enclosed structure that contain spooled or coiled material on the dispenser, particularly when the dispenser is situated on an incline. Furthermore, these elements so joined form a rotary material support upon which material is dispensed. This rotating upper assemblage is joined to the dispenser base (leg members) with steel bolt 32*a* (see axis assembly above) which serves as the axis member proper. Tightening nylon-type lock nut 34*a* of the axis assembly compresses brass washer 24*a* and Teflon washer 26*a* equally. However, the lower coefficient of friction of Teflon washer 26*a* and the reduced contact area at the intersection of the upper surface of upper leg 20*a*, Teflon washer 26*a*, and the under surface of lower arm 19*a* due to the curvature of upper leg 20*a* permit rotation of the upper assemblage described above while securely joining the dispenser base and upper assemblage. A friction brake action is effectively achieved by adjusting the tension of nylon-type lock nut 34*a* to allow the desired rotation while preventing unwanted free rotation when dispensing material. One post 16*a* is attached to each side of upper arm 18*a* and upper arm 19*a* as guides for the inner diameter of spooled material. Finally, one coil support 38*a* is placed at each extremity of the upper surface of lower arm 19*a* adjacent to post 16*a* (see FIG. 5). The polyurethane foam composition of coil support 38*a* allows a compression of the width to permit coil support 38*a* to be frictionally attached to the upper surface (partially within the channel walls) of lower arm 19*a* in the working or open position. Coil support 38*a* thereby acts to bridge the gap between the upper surface of lower arm 19*a* and the upper surface of upper arm 18*a*, providing a net level surface for spooled material placed on the dispenser. Material may be loaded onto the thus configured dispenser and reeled out by pulling the end of the spooled roll up and over rail 14*a* in any direction. The paired rail 14*a* in the open or working position serve as a guide to prevent material thus dispensed from fouling the dispenser operation.

To close the dispenser, the above steps are simply reversed. The tension lock pin assembly 40*a* is then re-inserted through the alignment holes. The tension lock pin assembly 40*a* is held in place regardless of the orientation of the stored dispenser by the action of the tension of the looped braided cable acting upon the steel dowel member, pressing the dowel sideways against the alignment holes. The paired rail 14*a* in the closed or storage position may serve as a shoulder strap for hands free carrying of the dispenser. One coil support 38*a* is stored underneath and partially within the channel walls on each side of lower leg 21*a* in the closed or storage position.

Description (Third Embodiment) FIGS. 10, 15 & 16

FIGS. 10, 15 & 16 is a third embodiment of the dispenser in the closed or storage position. As with the previous embodiments, the preferred material is a 6061 T-6 sharp cornered aluminum channel. The configuration of this third embodiment is basically the same as the first embodiment; the major difference from the first embodiment being as follows:

The use of a single identically manufactured piece for both upper leg 20*b* and lower leg 21*b* members rather than two concentrically curved members, and both leg members are positioned with the channel facing upward (not shown);

40*b* lock pin, 45*b* chain and 41*b* pin retainer are installed on upper arm 18*b;*

Spring 43*b*, hinge lock 42*b* and closing guide 36*b* are installed on the floor of lower leg 21*b* opposite upper leg 20*b;*

Foot 47*b* is attached to each extremity of upper leg 18*b*, while multiple foot pad 48*b* are attached along the bottom of lower leg 21*b;*

However, all other associated axis members are configured exactly the same as described in the first embodiment.

This embodiment might incorporate the combined lower bearing holder 33 and round spacer 31 into one manufactured piece with a formed ridge substituting for the adjacent steel washer as stated in the first embodiment description (not shown). Due to the greater arm component height in this embodiment and subsequently greater disparate upper and lower arm surface height, coil support 38*b* (shown in storage position) are employed to bridge the gap between the arm components in the open position as coil support 38*a* described in the second embodiment above.

Operation (Third Embodiment)

The third embodiment operates in the same manner as the first embodiment presented above, With the following differences:

Spring 43*b* lifts hinge lock 42*b* upward from lower leg 21*b* to contact upper leg 20*b* in the open position;

Closing guide 36*b* contacts the lower surface of upper leg 20*b* in the closed position;

Lock pin 40*b* is inserted downward into receiving holes (not shown);

Pin retainer 41*b* secures lock pin 40*b* in the fully inserted position (not shown);

Coil support 38*b* is mounted on each side of lower arm 19*b* in the open position. Coil support 38*b* thereby acts to bridge the gap between the upper surface of lower arm 19*b* and the upper surface of upper arm 18*b*, providing a net level surface for spooled material placed on the dispenser.

Description (Fourth Embodiment) FIGS. 17-27

A fourth embodiment of the collapsible reel-type dispenser (here after dispenser is illustrated in FIG. 17. Formed channel sections are incorporated to provide a lower leg 21*d*, and upper leg 20*d*, a lower arm 19*d* and an upper arm 18*d*, all joined by an axis assembly (see description below) In this embodiment, the channel legs all face upward.

The axis assembly is comprised as follows: (see FIG. 27)

A steel bolt 32*d* is passed in succession through a hardened steel washer 27*d*, a nylon washer 28*d*, hardened steel washer 27*d*, a thrust ball bearing 26*d*, hardened steel washer 27*d*, an upper bearing holder 23*d*, upper arm 18*d*, a strikeplate 24*d*, a spacer 22*d*, lower arm 19*d*, a 1½" steel washer 29*d*, hardened steel washer 27*d*, thrust ball bearing 26*d*, hardened steel washer 27*d*, a lower bearing holder 33*d*, a tubing guide 35*d*, 1½" steel washer 29*d*, spacer 22*d*, upper leg 20*d*, strikeplate 24*d*, spacer 22*d*, lower leg 21*d*, a steel washer 30*d* and a nylon-type lock nut 34*d*. Tubing guide 35*d* may rotate freely around the lower portion of lower bearing holder 33*d*. Strikeplate 24*d*, form fits onto the bottom of upper leg 20*d* and upper arm 18*d* to reinforce the corner edges of the outer channel. A lower bearing seal 25*d* fits into a corresponding circular channel in the top of lower bearing holder 33*d* and is capped by the 1½" steel washer 29*d* immediately above in the axis assembly so to effectively seal thrust ball bearing 26*d* from dirt and moisture. An upper seal 37*d* is placed into the bore of upper bearing holder 23*d* to effectively seal thrust ball bearing 26*d* from dirt and moisture.

A closing guide 36*d* is attached to one side of the inner channel floor of lower leg 21*d* and lower arm 19*d* (FIGS. 17 & 19*a*). A first end of a lock element 42*d* is attached to lower leg 21*d* and lower arm 19*d*, lock element 42*d* having a second end selectively positional to detachably engage the adjoining upper leg 20*d* and upper arm 18*d*, respectively, in the open dispensing position (FIG. 26). As will be apparent to one skilled in the art, a variety of means may be employed to accomplish the lock element; by way of example and not limitation, the lock element might be a sliding lock element having a first end connected to a first arm or leg component and having a sliding selectively positional second end to detachable engage the adjoining arm or leg component (not shown), or a hooking lock element having a first end connected to a first arm or leg component and having a hooking selectively positional second end to detachably engage the adjoining arm or leg component (not shown).

In this embodiment, but not always, the first end of lock element 42*d* is connected to the inner channel floor of lower leg 21*d* and lower arm 19*d* as follows: a screw 7*d* passed in succession through the channel floor, lock spacer 3*d*, spring 43*d*, stand off 8*d*, lock element 42*d* and dome nut 13*d*. Dome nut 13*d* also functions as the closing guide opposite to closing guide 36*d*.

A foot pad 48*d* is attached along the bottom of each side of lower leg 21*d*. To each extremity of upper leg 20*d* is attached a foot 47*d*. To each extremity of lower arm 19*d* is attached an end bracket 15*d*. To each extremity of upper arm 18*d* is attached a standoff 8*d*.

A coil support 38*d* is an EVA foam block that is compressed to fit into lower arm 19*d* in the open position and into upper leg 20*d* in the storage position. Coil support 38*d* is of sufficient height so as to contact material placed upon upper arm 18*d* in the open position and thereby transmit load forces to lower arm 19*d* and provide a net level surface for a coil being dispensed.

A shock cord tensioner 44*d* with a hook on one end and an eyehole on the other is attached to upper arm 18*d*. A hole is located in the floor of lower leg 21*d* adjacent to the channel wall to receive the hook end of shock cord lock 40*d* in the storage position, wherein shock cord tensioner 44*d* loops over top bar 17*d* to secure it to the tool.

A shock cord lock 40*d* with a hook on one end and an eyehole on the other is attached to the extremity of upper leg 20*d*. Shock cord lock 40*d* is looped around the dispenser in the storage position and hooked onto upper arm to lock the adjoining swiveling components in parallel alignment for storage.

A top bar 17*d* is an elongated bar which is placed upon the upper coil of material dispensed to retain the upper coils. Each end of top bar 17*d* is angled at approximately 45 degrees to fit within the channel walls of upper arm 18*d* in the closed storage position. A slot with a hole located on either side is centrally located on top bar 17*d* to receive the hook end of shock cord tensioner 44*d* when dispensing material.

In this embodiment, the inner diameter guide for the coil of material dispensed is an adjustable guide assembly as follows: (see FIGS. 20-25)

A slider element 100 is placed within a retainer channel 80, retainer channel 80 having a capped U shaped cross section and further having a sloped tab 90 located in series at predetermined intervals along the channel floor, the tabs protruding upwards. Slider element 100 is a formed element having opposing side walls, with each opposing side wall section having a hole 120. At the top and bottom of the rear section of slider element 100 are located a flap 140, slider element 100 being slidable along the length of retainer channel 80.

FIGS. 20 & 22 show a inner tubing support comprised of a channel post 160 and a flex post 166. Channel post 160 is a U shaped channel having corresponding leg slot 162 on the two opposing lower channel leg section and having a hook tab 180 angled inward and upward protruding into the U shaped cross section interior which further defines a centered slot 164. Flex post 166 is housed within the upper U shaped channel of channel post 160 and is attached for slidable adjustment to centered slot 164 with a screw, washer and nut combination which is tightened to allow frictional controlled sliding of flex post 166 up or down within channel post 160. Channel post 160 is placed upright within the side walls of slider element 100 with the back wall of channel post 160 contacting and supported by flap 140 at the top and bottom rear section of slider element 100, the bottom end of channel post 160 thus placed contacting the floor of retainer channel 80. A pin 200 and a spring 220 are incorporated to connect channel post 160 to slider element 100 as follows: (see FIG. 20)

Pin 200 is placed consecutively through hole 120 of one side wall of slider element 100, one leg slot 162 of channel post 160, a first end of spring 220, the opposing leg slot 162 of channel post 160, and the opposing hole 120 of slider element 100. The second end of spring 220 is then placed onto hook tab 180 protruding into the U shaped cross section interior of channel post 160.

Operation

The operation of the dispenser is as follows (starting with the closed or storage position): To open the dispenser, the hook end of shock cord tensioner 44*d* is detached from the hole located in the floor of lower leg 21*d* (not shown), releasing top bar 17*d* form it's storage position; top bar 17*d* is temporarily set aside. Shock cord lock 40*d* is unhooked from upper arm 18*d* effectively unlocking the arm and leg components and tubing guide 35*d* to rotate freely around the axial assembly. Lower leg 21*d* is rotated perpendicular to upper leg 20*d*, allowing lock element 42*d* to lift up into position against upper leg 20*d* by means of spring 43*d*, effectively locking the combined leg members as a single lower assemblage and so combined form the dispenser base.

Lower arm 19*d* is rotated perpendicular to upper arm 18*d*, allowing lock element 42*d* to lift up into position against upper arm 18*d* by means of spring 43*d*, effectively locking the combined arm members as a single upper assemblage. Coil support 38*d* are removed from upper leg 20*d* and placed onto lower arm 19*d* to bridge the height gap between the arm components in the open position and thereby provide a net level surface for a coil being dispensed.

Channel post 160 are raised into position and adjusted to fit the coil inner diameter. Flex post 166 may be raised within channel post 160 to accommodate varying roll heights of the material dispensed. (see 'Operation: adjustable guide assembly' below)

The roll of material to be dispensed is placed upon the combined arm member upper assemblage with channel post 160 positioned adjacent to the inner diameter of the rolled material. Top bar 17*d* is then placed with the 45 degree angled end portions of top bar 17*d* facing upwards and lowered onto the top of the roll of material. The hook end of shock cord tensioner 44*d* is then grasped and pulled upward and through the centrally located slot of top bar 17*d* and shifted longitudinally so as to position the hook end of shock cord tensioner 44*d* to align with and lower into one of the two holes on either side of the center slot. The shock cord tensioner 44*d* thus attached exerts a downward tension upon top bar 17*d*, thus securing the roll of material upon the dispenser and preventing the unwinding coils from lifting up and over channel post 160 and thereby fouling the dispenser operation.

Thrust ball bearing 26 located above and below the so combined arm members allow the free rotation of the single upper assemblage in the open position and thus provide a rotary material support upon which material to be dispensed is placed.

Material may be loaded onto the thus configured dispenser and reeled out by pulling the end of the spooled roll through the looped end of the tubing guide 35*d* and proceeding. Tubing guide 35*d* directs the tubing off the roll downward to help prevent fouling and may rotate in any direction around the dispenser as required. To load a replacement roll of material, shock cord tensioner 44*d* is detached from top bar 17*d*, which is then removed and temporarily set aside. A new roll is installed in place, top bar 17*d* is re-installed and shock cord tensioner 44*d* re-attached as before.

To close or collapse the dispenser, the hook end of shock cord tensioner 44*d* is detached from top bar 17*d* and top bar 17*d* is removed and temporarily set aside. Channel post 160 are lower into the horizontal storage position (see 'Operation: adjustable guide assembly' below) Coil support 38*d* are removed from lower arm 19*d* and placed onto upper leg 20*d*. Lock element 42*d* on lower arm 19*d* is depressed so as to disengage contact with upper arm 18*d* and allow lower arm 18*d* to rotate from the open perpendicular position into the closed parallel position, directly aligned with upper arm 19*d*. Lock element 42*d* on lower leg 21*d* is depressed so as to disengage contact with upper leg 20*d* and allow upper leg 20*d* to rotate from the open perpendicular position into the closed parallel position, directly aligned with lower leg 21*d*. Tubing guide 35*d* is rotated into position parallel with the arm and leg members. Shock cord lock 40*d* is looped around the thus positioned components and attached by the hood end to upper arm 18*d*.

Top bar 17*d* is recovered and secured upon the top of upper arm 18*d* as follows: the 45 degree angled end sections of top bar 17*d* are positioned facing downward and fitting inside the channel walls of upper arm 18*d*, with each end of top bar 17*d* abutting standoff 8*d*. The hook end of shock cord tensioner 44*d* is then stretched over the top of top bar 17*d* and downward below lower leg 21*d* and hooked into the hole located in the floor of lower leg 21*d* adjacent to the channel wall, thus securing top bar 17*d* upon upper arm 19*d*.

Operation: Adjustable Guide Assembly

In the upright working position, channel post 160 as described above and so assembled onto slider element 100 may be slided forward along retainer channel 80 to accommodate varying roll inner diameters of the material dispensed, the bottom end of channel post 160 pulled downward by spring 220 and riding up and over the sloped tab 90 on the floor of retainer channel 80. Movement rearward of channel post 160 is prevented by contact of the bottom end of the back wall of channel post 160 with the upward protruding sloped tab 90 of retainer channel 80. The lower flap 140 at the rear section of slider element 100 prevents channel post 160 from pivoting, thereby effectively locking channel post 160 in the upright working position. Flex post 166 may be moved up or down within channel post 160 may be unlocked from contact with sloped tab 90 of retainer channel 80 and thus allow it to be repositioned as desired along retainer channel 80, or to allow channel post 160 to clear lower flap 140 at the rear section of slider element 100 and be swiveled upon pin 200 into a horizontal position for storage, wherein the lower channel leg section of channel post 160 is retracted by spring 220 within and retained by flap 140 at the top and bottom rear section of slider element 100, thereby effectively locking channel post 160 in the horizontal storage position.

to move channel post 160 into the upright working position, channel post 160 is pulled outward horizontally so as to allow the lower channel leg section to clear flap 140 at the bottom rear section of slider element 100 and be pivoted vertically into the upright working position, wherein spring 220 pulls the bottom end of channel post 160 into contact with the floor of retainer channel 80 and flap 140 at the rear section of slider element 100

Description: Optional Roller Track FIG. 11

FIG. 11 shows an optional roller track assembly joined onto an embodiment very similar to the third embodiment described above; however the cross section of the extrusion of this example consists of a partially capped sharp cornered U channel with additional elements protruding at the top of each channel leg. The roller track option could be used with a variety of component profile and cross section, so the example included is to demonstrate the roller track only. This optional roller track incorporates roller track 50*c* attached with hinge 57*c* and connecting element 55*c* to the upper leg. Certain embodiments employing cast or molded manufacture would have formed surface section as part of upper leg, thus negating connecting element 55*c* (not shown). Roller track 50*c* could optionally be formed with the track section termination points extending further out so as to meet and interlock at the center point of and above the upper leg in the open position (not shown).

A support element 54*c* extends essentially perpendicular from the bottom surface of roller track 50*c* to a distance equal to the distance between the roller track 50*c* lower surface and the immediate underlying lower leg upper surface in the open position. Roller element 51*c* is attached to the uppermost arm and roller element 52*c* is attached to the lower arm, each roller element extending downward and terminating in roller 53*c* so as to situate roller 53*c* upon roller track 50*c*. Track sweeper element are optionally attached to roller element 51*c* upon roller sides of the direction of travel of roller 53*c* (not shown).

Operation: Optional Roller Track

The roller track option operates as follows:

When the dispenser is configured in the open position, each roller track 50*c* is moved from a vertical position for storage into a horizontal position, thereby together with the connecting element 55*c* forming an essentially contiguous track. The protruding support element 54*c* of track section 50*c* contacts the underlying lower upper surface so as to rest upon the underlying leg component. Roller 53*c* of roller element 51*c* and roller element 52*c* may roll upon the so combined track section, whereby the roller element transmit load forces from the arm component to the lower leg component when the collapsible apparatus is holding, reeling out or reeling in elongate flexible member of a coiled article in the open essentially perpendicular position for dispensing. The optional sweeper elements remove debris ahead of the roller 53*c* (not shown). The addition of the track and roller components provides additional support and stability for use in applications requiring heavier materials load bearing requirements, and also provides greater apparatus stress capacity in embodiments used for reeling in elongate flexible member onto the apparatus.

Description: Optional Hex Shaft Member FIG. 12

FIG. 12 shows an optional method of joining at least one arm or leg component of the dispenser to the axial member. A hex spacer 75 is axially perforated to receive an axial bolt 77, hex spacer 75 having a hexagonal shaped niche on one surface of sufficient depth so as to receive and secure the hexagonal shaped bolt head of axial bolt 77. To receive axial bolt 77, hex spacer 75 is axially located within the channel walls of either the uppermost arm component or, in embodiments having the lowermost channel legs facing downwards, the lowermost leg component of the dispenser (not shown).

FIG. 12 also shows an extended shaft member 79, similar to axial bolt 77 yet having an extended axial shaft. To receive extended shaft member 79, hex spacer 75 is axially installed within the channel walls of a least one arm or leg component, with the extended axial shaft of extended shaft member 79 protruding above or below the aggregate arm and leg component of the apparatus. Extended shaft member 79 could be a solid, tubular, geared, or contain another rotational energy transmitting mechanism (not shown).

Operation: Optional Hex Shaft Member

Axial bolt 77 is placed through hex spacer 75 so that the hexagonal shaped niche of hex spacer 75 receives and secures the hexagonal shaped head of axial bolt 77, thereby essentially engaging axial bolt 77 with hex spacer 75 and thereby effectively interlocking axial bolt 77 to the associated component. Extended shaft member 79 is likewise placed through hex spacer 75, thereby effectively interlocking extended shaft member 79 to the associated component. Rotational drive means may be optionally attached to the end of axial bolt 77 or extended axial shaft 79 so as to turn the upper arm assemblage.

Description: Optional Component Lock FIGS. 13 & 14

FIG. 13*a* shows the upper surface of the lower adjoined arm or leg component having an major indent 61 located axially perpendicular to the component length, and a minor indent 63 situated axially parallel to the component length, minor indent 63 similarly shaped as indent 61 yet being substantially shallower. The indent of both major indent 61 and minor indent 63 are formed with vertically sloped walls and are essentially V-shaped in cross section.

FIG. 13*b* shows the undersurface of the upper arm or leg component having a protrusion 65 located axially parallel to the component length. Protrusion 65 is shaped essentially opposite to the V-shape of major indent 61, yet slightly smaller in scale.

A compression of the so combined arm and leg members located upon the axial assembly is provided by a spring 67 (FIG. 14). Spring 67 is located either above or below the aggregate arm and leg component, on the axial bolt member and between the bolt head and nut tightening component of the axial assembly. An alternate location for the spring would be integrated within the axial assembly, having each opposite end of the spring essentially joined to each opposite terminating component of the collapsible apparatus (not shown).

Operation: Optional Component Lock

The urging of spring 67 or the alternate axially integrated spring creates a compression of the aggregate component of the dispenser. Beginning with the adjoined component in the parallel orientation for storage position (FIG. 14*b*), each component so adjoined is grasped and rotated oppositely into the perpendicular open position for dispensing. In this perpendicular position, protrusion 65 is in exact alignment with major indent 61 and is therefore pressed into so as to nestle within major indent 61 by the aforesaid compression (FIG. 14*a*). The adjoining component are now essentially locked together as one assemblage.

To disengage the so adjoined component, each component so adjoined is grasped and rotated oppositely to the other with the tangential force thereby applied leveraging protrusion 65 out of major indent 61 by means of the vertically sloped walls of major indent 61 and the resulting decompression of the aggregate component of the dispenser by the so applied force overcoming the urging of spring 67. The thus unlocked components are rotated into the parallel closed position for storage (FIG. 14*b*). In this parallel position, protrusion 65 is in exact alignment with minor indent 63 and is therefore pressed into so as to partially nestle within minor indent 63 by the aforesaid compression. As minor indent 63 is only of slight scale compared to major indent 61, the resulting nestling is very slight and results in a gentle locking action of the so adjoined component in the storage position.

Other shapes and cross sections could be used for the indent and protrusion as required by the embodiments intended use. For example, one side of the V-shaped cross-section could be vertical to better lock against the direction of pull, requiring movement in the opposite direction to unlock the components.

SUMMARY, RAMIFICATIONS AND SCOPE OF INVENTION

From the proceeding description it may be said that the stated purpose of this invention has been achieved, that being to provide a truly portable reel type dispenser with collapsibility to ease transport and storage, with economy of design to facilitate low unit cost and weight, having good durability, with a fully contained stand to allow set up apart from the availability of stud members or case components, with quick set up and demounting time, and that in certain embodiments can be used to reel-in material.

Although the description above contains many specificities, these should not be construed as limiting the scope of the invention but as merely providing illustrations of some of the presently preferred embodiments of the invention. For example, the leg components of the first embodiment might be a D-shaped continuous form with the lower leg fitting concentrically within the upper leg, the flat portion of the D-shape forming the base segment proper. Furthermore, these leg components might be axially coupled at the lower crossing of the intersecting base segments. Also, additional leg and arm components might be employed to provide enhanced load bearing capacity.

As briefly pointed out in the description of the second embodiment above, molded manufacturing techniques would allow a great simplification of the apparatus. As stated a protrusion axially located on an arm or leg component could act as a defacto bearing surface. This would especially apply to certain plastic material compositions having low coefficient of friction, such as VHMWPE (Very High Molecular Weight Polyethylene) plastic, this particular material also possessing outstanding strength so as to provide a highly durable component that could stand up to field conditions. Further, in some embodiments the material composition itself would essentially act as a bearing surface apart from any protrusions or formed additions to the finished surface of the component.

The hinge lock could be formed without the perforation, and retained on the channel floor by a pin installed across and through the channel walls to capture the hinge lock at the curved segment, or a bracket installed adjacent to the hinge lock having an appendage arching over and terminating with a formed extremity to capture the hinge lock at the curved segment. Also, the adjoining component hinge lock element could be substituted with any of the following: a sliding lock assembly or element having one end slidably connected to one component and a second end thereby selectively positional so as to engage the adjacent component; a pivoting lock assembly or element having one end pivotably connected to the first component and a second end thereby selectively positional so as to engage the adjacent component; a hook or hooking lock element having one looped end attached to an eyehole connector on one component and having a second hooked end thereby selectively positional so as to engage the adjacent component with the hook, and so on. Tubing guide 35 might be replaced with a guide rotatably attached to the upper axial assembly and arching up and over the coiled article, or a guide attached to a leg component and extending out to position an enclosed guide loop for the dispensed material, and so on.

The post elements that serve as the inner coil guide could be replaced with an assemblage wherein the post element are hingedly attached to slide element, the slide element retained upon the arm component itself or upon a slide element retaining member attached to the arm component, and thereby be optionally positioned along the length of the arm or folded down into a storage position. Some embodiments would not require any post members due to the density and composition of the material itself such as electrical conduit tubing with thicker wall dimension, in which case the Top Bar element pressing down upon the roll upper surface would suffice to keep the roll disciplined while uncoiling. In this embodiment, the top bar could be shaped with a dip in the center portion to give better support to the material roll inner diameter, and would not have holes aligning with post members as is the case of the embodiments described herein. Finally, opposite ends of one elastic tensioning element could be attached to each opposite side of the upper arm, and then pulled upward through the roll inner diameter to attach to the upper retaining element at two opposite locations corresponding to the roll inner diameter, thus providing inner diameter support to the rolled material and tensioning the upper retaining guide element downward, thereby replacing post and shock cord assembly member described herein.

Certain embodiments might include additional foot components along the side of the upper leg element, or wheels on the leg and/or foot components for mobility. Wheels might be attached to the outer extremity of the arm component so as to contact the ground for additional load bearing capacity. The axial member could be engaged with an arm or leg component by any of a variety of methods, including a one-piece element combining the axial member with an interlocking member or with at least one arm or leg component. Arrays of combinations are possible by the inclusion of the optional extended axial shaft member for mating the invention with rotational drive means to reel in as well as reel out material, as well as facilitating adaptations of the invention for other uses using its general principles.

More significant are the multitudinous variations and embodiments for more specific or specialized purposes. These might include a portable garden hose stand with drive means to re-wind the garden hose onto the apparatus, or a portable display stand, optionally with a drive component to revolve the upper rotating assemblage. Another use might be as a portable work station organizer and access aid, allowing a worker to rotate bins of components placed upon the upper rotating assemblage to provide greater productivity, and so on.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A collapsible dispenser for holding and dispensing a coiled reel comprising:

a lower leg; an upper leg rotatably mounted by a bolt and bearing combination to said lower leg; said bolt and bearing combination supporting a lower arm; said lower arm rotatably mounted by said bolt and bearing combination to an upper arm, wherein said lower and upper leg and said lower and upper arm are selectively positional around said bolt and bearing combination into a collapsed parallel position for storage and an open perpendicular position for dispensing; and a lock element, said lock element having a first end connected to said lower leg and lower arm, said lock element having a second end; said second end selectively positional to detachably engage said upper leg and upper arm in said open perpendicular position; and an adjustable guide member for the coil inner diameter connected to the dispenser into a horizontal storage position and an open upright position for dispensing.

2. The collapsible dispenser according to claim 1, wherein said lower leg and lower arm and said upper leg and upper arm are u-shaped channel having the channel legs of the u-shaped channel facing up.

3. The collapsible dispenser according to claim 1, wherein said first end of said lock element is hingedly coupled to said lower leg and lower arm; a spring; said spring retained upon said lower leg and lower arm and abutting said lock element, wherein said spring compels said lock element to move said second end into engagement with said upper leg and upper arm in said open perpendicular position.

4. The collapsible dispenser according to claim 1, wherein said adjustable guide member is an adjustable guide assembly further comprising: a slider element attached to a post with a spring and a pin, said slider element slidably mounted on the dispenser with a retainer, said slider element having a flap contacting said post in said open upright or horizontal storage position, said retainer having a tab contacting said post in said open upright position; and wherein said flap locks said post in said open upright or horizontal storage position by said spring and said pin, and wherein said tab selectively prevents travel of said post in said open upright position by said spring and said pin.

5. The collapsible dispenser according to claim 1, wherein a shock cord assembly having a shock cord with a hook attachment on one end and an eyehole on the other wherein said eyehole is secured to the dispenser.

6. The collapsible dispenser according to claim 5, further comprising a top bar laid across the coiled reel and said hook attachment of said shock cord assembly is attached to said top bar to hold the coil reel in tension.

7. The collapsible dispenser according to claim 1, wherein a tubing guide rotatably affixed to said bolt and bearing combination at a first tubing guide end and having a looped end at a second tubing guide end for guiding material from the coiled reel.

8. The collapsible dispenser according to claim 1, further including the use of a coil support member attached to said lower arm and being of sufficient height so as to contact material placed upon said upper arm and thereby transmit load forces to said lower arm and stabilize the material so placed.

9. The collapsible dispenser according to claim 1, wherein a spring and said first end of said lock element are securely attached to said lower leg and lower arm located relative to said upper leg and upper arm, wherein when said lower leg and lower arm are perpendicular to said upper leg and upper arm said second end of said lock element is detachably engaged to said upper leg and upper arm.

10. The collapsible dispenser according to claim 1, wherein said lock element is a sliding lock element having said first end connected to said lower leg and lower arm, said sliding lock element having a sliding second end; said sliding second end selectively positional to detachably engage said upper leg and upper arm in said open perpendicular position.

11. The collapsible dispenser according to claim 1, wherein said lock element is a hooking lock element having said first end connected to said lower leg and lower arm, said hooking lock element having a hooking second end; said hooking second end selectively positional to detachably engage said upper leg and upper arm in said open perpendicular position.

* * * * *